US012104833B2

(12) United States Patent
Qiu et al.

(10) Patent No.: US 12,104,833 B2
(45) Date of Patent: Oct. 1, 2024

(54) AIR CONDITIONER AND CONTROL METHOD THEREFOR

(71) Applicants: GD MIDEA AIR-CONDITIONING EQUIPMENT CO., LTD., Foshan (CN); MIDEA GROUP CO., LTD., Foshan (CN)

(72) Inventors: Xiangwei Qiu, Foshan (CN); Xiangyang Li, Foshan (CN); Hao Zhang, Foshan (CN); Kui Tao, Foshan (CN); Shunquan Li, Foshan (CN); Junjie Lei, Foshan (CN); Zhengxing Wang, Foshan (CN); Tianqui Zhu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 324 days.

(21) Appl. No.: 17/641,654

(22) PCT Filed: Mar. 13, 2020

(86) PCT No.: PCT/CN2020/079230
§ 371 (c)(1),
(2) Date: Mar. 9, 2022

(87) PCT Pub. No.: WO2021/047158
PCT Pub. Date: Mar. 18, 2021

(65) Prior Publication Data

US 2022/0307745 A1 Sep. 29, 2022

(30) Foreign Application Priority Data

Sep. 11, 2019 (CN) ..... 201910861756.8
Sep. 11, 2019 (CN) ..... 201921515639.8

(51) Int. Cl.
*F25B 47/02* (2006.01)
*F24F 1/08* (2011.01)
(Continued)

(52) U.S. Cl.
CPC ..... *F25B 47/025* (2013.01); *F24F 1/08* (2013.01); *F24F 1/14* (2013.01); *F24F 1/26* (2013.01);
(Continued)

(58) Field of Classification Search
CPC ..... F25B 47/025; F25B 13/00; F25B 2313/0233; F25B 2313/025;
(Continued)

(56) References Cited

U.S. PATENT DOCUMENTS 4,104,890 A 8/1978 Iwasaki
4,266,599 A 5/1981 Saunders
(Continued)

FOREIGN PATENT DOCUMENTS

CA 2572624 A1 6/2007
CN 201522044 U 7/2010
(Continued)

OTHER PUBLICATIONS

English translation of Okamoto (CN 104864495 A) (Year: 2015).*
(Continued)

*Primary Examiner* — Miguel A Diaz
(74) *Attorney, Agent, or Firm* — Anova Law Group, PLLC

(57) ABSTRACT

An air conditioner includes first and second refrigerant circulation systems each including an indoor unit including an indoor heat exchanger and an indoor throttle device, an outdoor unit including a compressor and an outdoor heat exchanger, an exhaust pipe arranged at an exhaust port of the compressor, an intake pipe arranged at an intake port of the
(Continued)

compressor, a liquid-side piping connecting the exhaust pipe, the outdoor heat exchanger, the indoor throttle device, and the indoor heat exchanger in sequence, and a gas-side piping connecting the indoor heat exchanger and the intake pipe. The air conditioner further includes a heat circulation device configured to convey heat energy or cold energy of at least one of the indoor heat exchanger of the first refrigerant circulation system or the indoor heat exchanger of the second refrigerant circulation system into a room.

17 Claims, 19 Drawing Sheets

(51) Int. Cl.
*F24F 1/14* (2011.01)
*F24F 1/26* (2011.01)
*F25B 13/00* (2006.01)

(52) U.S. Cl.
CPC ..... *F25B 13/00* (2013.01); *F25B 2313/0233* (2013.01); *F25B 2400/06* (2013.01); *F25B 2400/13* (2013.01)

(58) Field of Classification Search
CPC ..... F25B 2313/0253; F25B 2400/06; F25B 2400/13; F25B 5/00; F25B 5/02; F25B 6/00; F25B 6/02; F24F 1/08; F24F 1/14; F24F 1/26; F24F 1/28; F24F 1/30; F24F 1/32
See application file for complete search history.

(56) References Cited

U.S. PATENT DOCUMENTS

| | | | | |
|---|---|---|---|---|
| 2016/0209084 | A1* | 7/2016 | Kawano | F25B 39/00 |
| 2018/0095483 | A1* | 4/2018 | Tokudi | F24F 11/62 |

FOREIGN PATENT DOCUMENTS

| | | | |
|---|---|---|---|
| CN | 102425882 | A | 4/2012 |
| CN | 102538327 | A | 7/2012 |
| CN | 202561933 | U | 11/2012 |
| CN | 103032996 | A | 4/2013 |
| CN | 104251548 | A | 12/2014 |
| CN | 104764111 | A | 7/2015 |
| CN | 104864495 | A | 8/2015 |
| CN | 105042925 | A | 11/2015 |
| CN | 105805975 | A | 7/2016 |
| CN | 205939467 | U | 2/2017 |
| CN | 206131547 | U | 4/2017 |
| CN | 106627041 | A | 5/2017 |
| CN | 106705231 | A | 5/2017 |
| CN | 106885361 | A | 6/2017 |
| CN | 107192013 | A | 9/2017 |
| CN | 107763737 | A | 3/2018 |
| CN | 107816822 | A | 3/2018 |
| CN | 108072214 | A | 5/2018 |
| CN | 207350468 | U | 5/2018 |
| CN | 108151353 | A | 6/2018 |
| CN | 108302651 | A | 7/2018 |
| CN | 108443997 | A | 8/2018 |
| CN | 109405341 | A | 3/2019 |
| CN | 109612026 | A | 4/2019 |
| CN | 109631236 | A | 4/2019 |
| CN | 210832213 | U | 6/2020 |
| JP | H03274358 | A | 12/1991 |
| JP | 104155139 | A | 5/1992 |
| JP | 2001059664 | A | 3/2001 |
| JP | 2002243319 | A | 8/2002 |
| JP | 2003139436 | A | 5/2003 |
| JP | 2003212118 | A | 7/2003 |
| JP | 2005283064 | A | 10/2005 |
| JP | 2009115442 | A | 5/2009 |
| JP | 2013228130 | A | 11/2013 |
| JP | 2017015318 | A | 1/2017 |
| WO | 2012099141 | A1 | 7/2012 |

OTHER PUBLICATIONS

The European Patent Office (EPO) Extended Search Report for EP Application No. 20863438.6, Sep. 1, 2022 9 Pages.
World Intellectual Property Organization (WIPO) International Search Report and Written opinion for PCT/CN2020/079230 Jun. 22, 2020 14 Pages (Translation Included).
China National Intellectual Property Administration (CNIPA) Office Action 1 for 201910861756.8, Jan. 25, 2024 33 Pages (including translation).

* cited by examiner

AIR CONDITIONER AND CONTROL METHOD THEREFOR

CROSS-REFERENCE TO RELATED APPLICATIONS

The present application is a National Stage Entry under 35 U.S.C. § 371 of International Application No. PCT/CN2020/079230, filed on Mar. 13, 2020, which claims priority to Chinese Application No. No. 201910861756.8, filed in the Chinese Patent Office on Sep. 11, 2019, and entitled "AIR CONDITIONER AND CONTROL METHOD THEREFOR" and Chinese Application No. 201921515639.8, filed in the Chinese Patent Office on Sep. 11, 2019, and entitled "AIR CONDITIONER," the entire contents of all of which are incorporated herein by reference.

TECHNICAL FIELD

The present disclosure relates to the field of air-conditioning technologies, and more particularly, to an air conditioner and a control method therefor.

BACKGROUND

Due to a complexity of weather, an air conditioner needs to have multiple functions at the same time to meet people's needs. For example, in order to overcome weather with a very high humidity, people need an air conditioner with a dehumidification function. However, an existing air conditioner with the dehumidification function cannot provide enough heat energy to maintain an indoor temperature while dehumidifying.

SUMMARY

The present disclosure is mainly intended to provide an air conditioner, and aims to make the air conditioner have dehumidification and reheating functions.

In order to achieve the above object, the air conditioner provided by the present disclosure includes:

a first refrigerant circulation system including:

a first indoor unit and a first outdoor unit, where the first outdoor unit includes a first compressor and a first outdoor heat exchanger, and the first indoor unit includes a first indoor heat exchanger and a first indoor throttle device;

a first exhaust pipe arranged at an exhaust port of the first compressor, a first intake pipe arranged at an intake port of the compressor, and a first liquid-side piping connecting the first exhaust pipe, the first outdoor heat exchanger, the first indoor throttle device and the first indoor heat exchanger in sequence; and a first gas-side piping connecting the first indoor heat exchanger and the first intake pipe;

a second refrigerant circulation system including:

a second indoor unit and a second outdoor unit, where the second outdoor unit includes a second compressor and a second outdoor heat exchanger, and the second indoor unit includes a second indoor heat exchanger and a second indoor throttle device;

a second exhaust pipe arranged at an exhaust port of the second compressor, a second intake pipe arranged at an intake port of the compressor, and a second liquid-side piping connecting the second intake pipe, the second outdoor heat exchanger, the second indoor throttle device and the second indoor heat exchanger in sequence; and a second gas-side piping connecting the second indoor heat exchanger and the second exhaust pipe; and a heat circulation device configured to convey heat energy or cold energy of the first indoor heat exchanger and the second indoor heat exchanger into a room.

In some embodiments, the air conditioner includes an indoor casing, and the first indoor heat exchanger and the second indoor heat exchanger are arranged in the indoor casing.

In some embodiments, the indoor casing is provided with an air inlet, an air outlet and an air duct connecting the air inlet and the air outlet;

the first indoor heat exchanger and the second indoor heat exchanger are arranged in the air duct; and the heat circulation device includes a fan, and the fan is arranged in the air duct.

In some embodiments, the air conditioner includes an outdoor casing, and the first outdoor heat exchanger and the second outdoor heat exchanger are arranged in the outdoor casing.

In some embodiments, the first outdoor heat exchanger and the second outdoor heat exchanger are integrally arranged, and refrigerant pipes of the first outdoor heat exchanger and the second outdoor heat exchanger are arranged in a same fin set.

In some embodiments, the first outdoor heat exchanger includes a plurality of first refrigerant pipe sections; and the second outdoor heat exchanger includes a plurality of second refrigerant pipe sections; and the first refrigerant pipe sections and the second refrigerant pipe sections are alternately arranged.

In some embodiments, the first refrigerant circulation system further includes a first reversing device, the first reversing device is arranged among the first exhaust pipe, the first liquid-side piping, the first gas-side piping and the first intake pipe, so that the first exhaust pipe is communicated with the first liquid-side piping, and the first intake pipe is communicated with the first gas-side piping; or, the first exhaust pipe is communicated with the first gas-side piping, and the first intake pipe is communicated with the first liquid-side piping.

In some embodiments, the first refrigerant circulation system further includes a first outdoor throttle device, and the first outdoor throttle device is arranged at the first liquid-side piping (liquid pipe); and/or, the second refrigerant circulation system further includes a second outdoor throttle device, and the second outdoor throttle device is arranged at the second liquid-side piping.

In some embodiments, the first refrigerant circulation system further includes: a first connection pipe branched from the first gas-side piping, and a second connection pipe branched from the first liquid-side piping; and the first refrigerant circulation system further includes a plurality of first indoor units, and the plurality of first indoor units are connected in parallel onto the first connection pipe and the second connection pipe.

In some embodiments, the first refrigerant circulation system further includes a first gas-liquid separator, and the first gas-liquid separator is arranged at the first intake pipe; and/or, the second refrigerant circulation system further includes a second gas-liquid separator, and the second gas-liquid separator is arranged at the second intake pipe.

In some embodiments, the second refrigerant circulation system further includes a second reversing device, the second reversing device is arranged among the second exhaust pipe, the second liquid-side piping, the second gas-side piping and the second intake pipe, so that the second exhaust pipe is communicated with the second liquid-side piping, and the second intake pipe is communicated with the second gas-side piping; or, the second exhaust pipe is communicated with the second gas-side piping, and the second intake pipe is communicated with the second liquid-side piping.

In some embodiments, the second refrigerant circulation system further includes: a third connection pipe branched from the second gas-side piping, and a fourth connection pipe branched from the second liquid-side piping; and the second refrigerant circulation system further includes a plurality of second indoor units, and the plurality of second indoor units are connected in parallel onto the third connection pipe and the fourth connection pipe.

In some embodiments, the air conditioner further includes a water treatment device, the water treatment device includes a water heat exchanger and a water container, and the water heat exchanger is configured to heat or refrigerate water in the water container;

the first refrigerant circulation system further includes: a first connection pipe branched from the first gas-side piping, and a second connection pipe branched from the first liquid-side piping, and the water heat exchanger and the first indoor unit are connected in parallel onto the first connection pipe and the second connection pipe; and/or, the second refrigerant circulation system further includes: a third connection pipe branched from the second gas-side piping, and a fourth connection pipe branched from the second liquid-side piping, and the water heat exchanger and the second indoor unit are connected in parallel onto the third connection pipe and the fourth connection pipe.

In some embodiments, the air conditioner further includes a heat exchange water tank and a floor-heating water flow pipe communicated with the heat exchange water tank, and a floor-heating heat exchanger is arranged in the heat exchange water tank;

the first refrigerant circulation system further includes: a first connection pipe branched from the first gas-side piping, and a second connection pipe branched from the first liquid-side piping, and the floor-heating heat exchanger and the first indoor unit are connected in parallel onto the first connection pipe and the second connection pipe; and/or, the second refrigerant circulation system further includes: a third connection pipe branched from the second gas-side piping, and a fourth connection pipe branched from the second liquid-side piping, and the floor-heating heat exchanger and the second indoor unit are connected in parallel onto the third connection pipe and the fourth connection pipe.

The present disclosure further provides a control method for the air conditioner, where the air conditioner includes a first indoor unit and a second indoor unit, the first indoor unit at least includes one first indoor heat exchanger, the second indoor unit at least includes one second indoor heat exchanger, and the control method for the air conditioner includes the following steps of:

acquiring a mode control instruction;

acquiring working demands of the first indoor heat exchanger and the second indoor heat exchanger according to the mode control instruction; and operating a first refrigerant circulation system and a second refrigerant circulation system according to the working demands of the first indoor heat exchanger and the second indoor heat exchanger.

In some embodiments, the step of acquiring the working demands of the first indoor heat exchanger and the second indoor heat exchanger according to the mode control instruction includes:

determining that the mode control instruction is a dehumidification and reheating mode instruction; and controlling one of the first indoor heat exchanger and the second indoor heat exchanger to refrigerate, and the other one to heat.

In some embodiments, the step of operating the first refrigerant circulation system and the second refrigerant circulation system according to the working demands of the first indoor heat exchanger and the second indoor heat exchanger specifically includes:

acquiring a refrigerating capacity demand in the dehumidification and reheating mode;

controlling a frequency of the compressor of the refrigerant circulation system corresponding to the indoor heat exchanger for refrigeration according to the refrigerating capacity demand;

acquiring a heating capacity demand in the dehumidification and reheating mode; and controlling a frequency of the compressor of the refrigerant circulation system corresponding to the indoor heat exchanger for heating according to the heating capacity demand.

In some embodiments, the step of acquiring the working demands of the first indoor heat exchanger and the second indoor heat exchanger according to the mode control instruction includes:

determining that the mode control instruction is a refrigerating mode instruction; and controlling the first indoor heat exchanger and/or the second indoor heat exchanger to refrigerate.

In some embodiments, the step of controlling the first indoor heat exchanger and/or the second indoor heat exchanger to refrigerate includes:

acquiring a refrigerating capacity demand in a refrigerating mode;

calculating a calculated working frequency needed by a single compressor according to the refrigerating capacity demand;

comparing the calculated working frequency with a first preset frequency range; and determining that the calculated working frequency is in the first preset frequency range, and controlling the first indoor heat exchanger or the second indoor heat exchanger to refrigerate.

In some embodiments, after the step of comparing the calculated working frequency with the preset frequency range, the method further includes the following step of:

determining that the calculated working frequency is out of the preset frequency range, and controlling the first indoor heat exchanger and the second indoor heat exchanger to refrigerate.

In some embodiments, the step of acquiring the working demands of the first indoor heat exchanger and the second indoor heat exchanger according to the mode control instruction includes:

determining that the mode control instruction is a heating mode instruction; and controlling the first indoor heat exchanger and/or the second indoor heat exchanger to heat.

In some embodiments, the step of controlling the first indoor heat exchanger and/or the second indoor heat exchanger to heat includes:

acquiring a heating capacity demand in a heating mode;

calculating a calculated working frequency needed by a single compressor according to the heating capacity demand;

comparing the calculated working frequency with a second preset frequency range; and determining that the calculated working frequency is in the second preset frequency range, and controlling the first indoor heat exchanger or the second indoor heat exchanger to heat.

In some embodiments, after the step of comparing the calculated working frequency with the preset frequency range, the method further includes the following step of:

determining that the calculated working frequency is out of the second preset frequency range, and controlling the first indoor heat exchanger and the second indoor heat exchanger to heat.

In some embodiments, after the step of acquiring the mode control instruction, the method further includes the following steps of:

acquiring working modes of the first outdoor heat exchanger and the second outdoor heat exchanger according to the mode control instruction; and operating the first refrigerant circulation system and the second refrigerant circulation system according to the working modes of the first outdoor heat exchanger and the second outdoor heat exchanger.

In some embodiments, the step of acquiring the working modes of the first outdoor heat exchanger and the second outdoor heat exchanger according to the mode control instruction includes:

determining that the mode control instruction is a defrosting mode instruction; and controlling the first outdoor heat exchanger and/or the second outdoor heat exchanger to heat.

In some embodiments, the step of controlling the first outdoor heat exchanger and/or the second outdoor heat exchanger to heat includes:

determining that a current defrosting mode is a no-feel defrosting mode;

controlling the first outdoor heat exchanger to refrigerate, and controlling the second outdoor heat exchanger to heat; or, controlling the first outdoor heat exchanger to heat, and controlling the second outdoor heat exchanger to refrigerate.

In some embodiments, the step of controlling the first outdoor heat exchanger to refrigerate, and controlling the second outdoor heat exchanger to heat includes:

acquiring an indoor ambient temperature and an outdoor ambient temperature;

calculating a refrigerating capacity or a heating capacity needed to maintain a current indoor ambient temperature; and according to the refrigerating capacity or the heating capacity needed, calculating operating frequencies of the first compressor and the second compressor, and controlling the first compressor and the second compressor to be operated according to the operating frequencies calculated.

In some embodiments, the step of, according to the refrigerating capacity or the heating capacity needed, calculating the operating frequencies of the first compressor and the second compressor, and controlling the first compressor and the second compressor to be operated according to the operating frequencies calculated includes:

according to the refrigerating capacity or the heating capacity needed, calculating a heating capacity needed to be provided by the first indoor heat exchanger and a refrigerating capacity needed to be provided by the second indoor heat exchanger;

calculating an operating frequency of the first compressor according to the heating capacity needed to be provided by the first indoor heat exchanger; and calculating an operating frequency of the second compressor according to the refrigerating capacity needed to be provided by the second indoor heat exchanger.

In some embodiments, the step of controlling the first outdoor heat exchanger and/or the second outdoor heat exchanger to heat includes:

determining that a current defrosting mode is an ordinary defrosting mode;

controlling the first outdoor heat exchanger to switch from refrigeration to heating, and controlling the second outdoor heat exchanger to stop heat exchange; or, controlling the second outdoor heat exchanger to switch from refrigeration to heating, and controlling the first outdoor heat exchanger to stop heat exchange.

In some embodiments, the step of controlling the first outdoor heat exchanger and/or the second outdoor heat exchanger to heat includes:

determining that a current defrosting mode is a forced defrosting mode; and controlling the first outdoor heat exchanger to heat, and controlling the second outdoor heat exchanger to heat.

In the technical solutions of the present disclosure, the first indoor heat exchanger performs dehumidification after the first compressor is operated, the second indoor heat exchanger provides heat energy after the second compressor is operated, then cold energy generated by the first indoor heat exchanger and heat energy generated by the second indoor heat exchanger are conveyed into a room through the heat circulation device, and during energy conveying, or after conveying the energy into the room, indoor air can not only be effectively dried, but also be heated by the heat energy; and since the first indoor heat exchanger and the second indoor heat exchanger are in two independent refrigerant systems respectively, power consumptions of the first indoor heat exchanger and the second indoor heat exchanger do not influence each other, and powers of the first compressor and the second compressor may be adjusted respectively according to needs of a user completely, so as to realize dehumidification and reheating, and even heating and dehumidification, thus not only solving humid weather such as "rainy season" for the user, but also greatly improving an adaptability of the air conditioner.

BRIEF DESCRIPTION OF DRAWINGS

In order to illustrate the technical solutions in the embodiments of the present disclosure or in the existing technology more clearly, the drawings to be used in the descriptions of the embodiments or the existing technology will be briefly described hereinafter. Obviously, the drawings in the following descriptions are merely some embodiments of the present disclosure, and for those having ordinary skill in the art, other drawings may also be obtained based on the structures shown in these drawings without any creative work.

Figure 1:
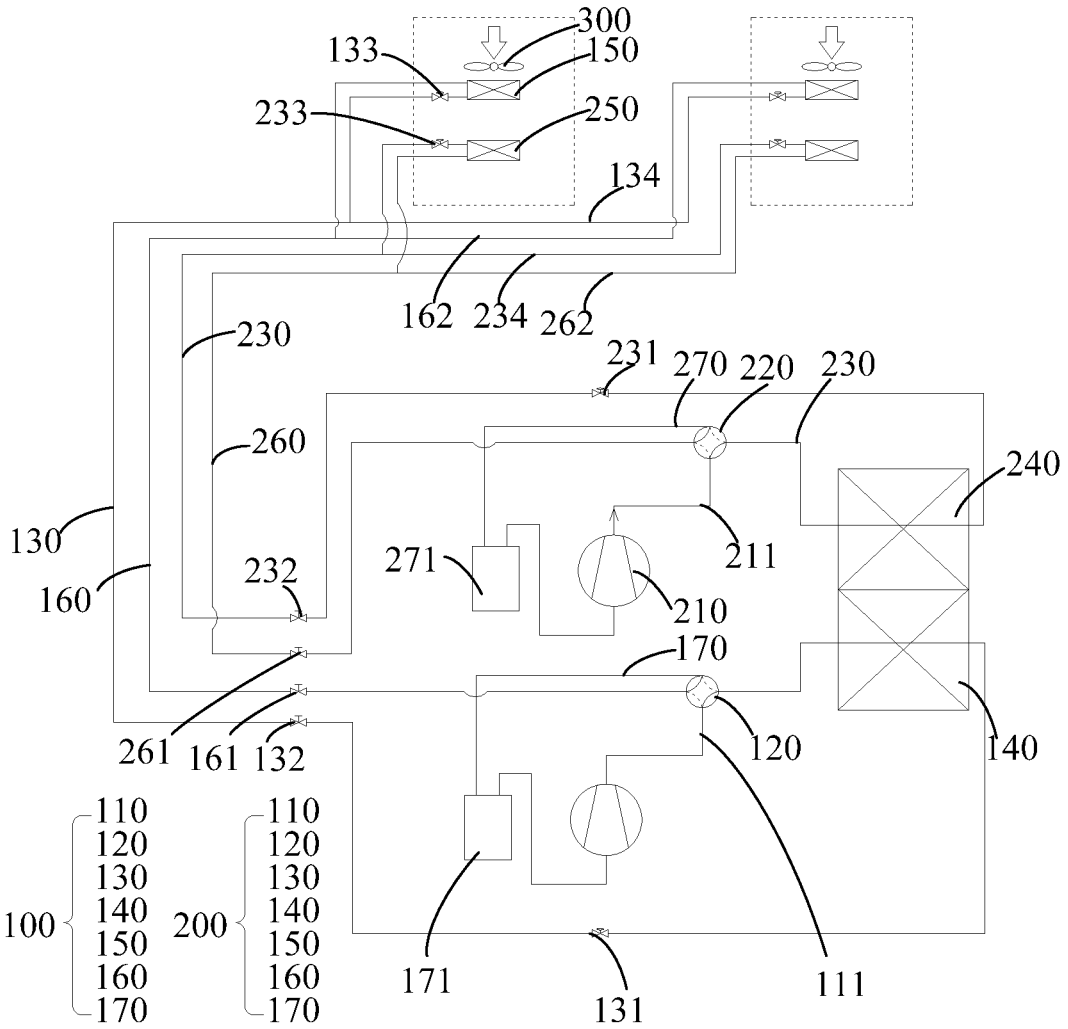
FIG. 1 is a schematic principle structural diagram of an air conditioner of the present disclosure.

Descriptions of reference numerals:

| Numeral | Name |
|---|---|
| 100 | First refrigerant circulation system |
| 110 | First compressor |
| 111 | First exhaust pipe |
| 120 | First reversing device |
| 130 | First liquid-side piping |
| 131 | First outdoor throttle device |
| 132 | First stop valve |
| 133 | First indoor throttle device |

-continued

Descriptions of reference numerals:

| Numeral | Name |
|---|---|
| 134 | First connection pipe |
| 140 | First outdoor heat exchanger |
| 141 | First refrigerant pipe section |
| 150 | First indoor heat exchanger |
| 160 | First gas-side piping |
| 161 | Second stop valve |
| 162 | Second connection pipe |
| 170 | First intake pipe |
| 171 | First gas-liquid separator |
| 200 | Second refrigerant circulation system |
| 210 | Second compressor |
| 211 | Second exhaust pipe |
| 220 | Second reversing device |
| 230 | Second liquid-side piping |
| 231 | Second outdoor throttle device |
| 232 | Third stop valve |
| 233 | Second indoor throttle device |
| 234 | Third connection pipe |
| 240 | Second outdoor heat exchanger |
| 241 | Second refrigerant pipe section |
| 250 | Second indoor heat exchanger |
| 260 | Second gas-side piping |
| 261 | Fourth stop valve |
| 262 | Fourth connection pipe |
| 270 | Second intake pipe |
| 271 | Second gas-liquid separator |
| 300 | Heat circulation device |
| 500 | Economizer |
| 510 | Liquid taking throttle valve |
| 520 | Liquid taking pipe |
| 530 | Return pipe |
| 540 | First refrigerant flow path |
| 550 | Second refrigerant flow path |
| 600 | Flash evaporator |
| 610 | Cylinder |
| 620 | Flash evaporation cavity |
| 630 | First liquid-phase refrigerant pipeline |
| 640 | Second liquid-phase refrigerant pipeline |
| 650 | Gas-phase refrigerant pipeline |

The realization of objects, the functional features and the advantages of the present disclosure are further described with reference to the drawings and the embodiments.

DETAILED DESCRIPTION

The technical solutions in the embodiments of the present disclosure are clearly and completely described with reference to the drawings in the embodiments of the present disclosure. Obviously, the described embodiments are merely some but not all of the embodiments of the present disclosure. Based on the embodiments in the present disclosure, all other embodiments obtained by those having ordinary skill in the art without going through any creative work should fall within the scope of protection of the present disclosure.

It should be noted that all directional indications (such as upper, lower, left, right, front, rear, etc.) in the embodiments of the present disclosure are merely used to explain the relative positional relationship, movement condition, etc. among various components under a certain specific posture (as shown in the drawings), and if the specific posture is changed, the directional indications are also changed accordingly.

A specific structure of an air conditioner will be mainly described hereinafter.

Figure 2:
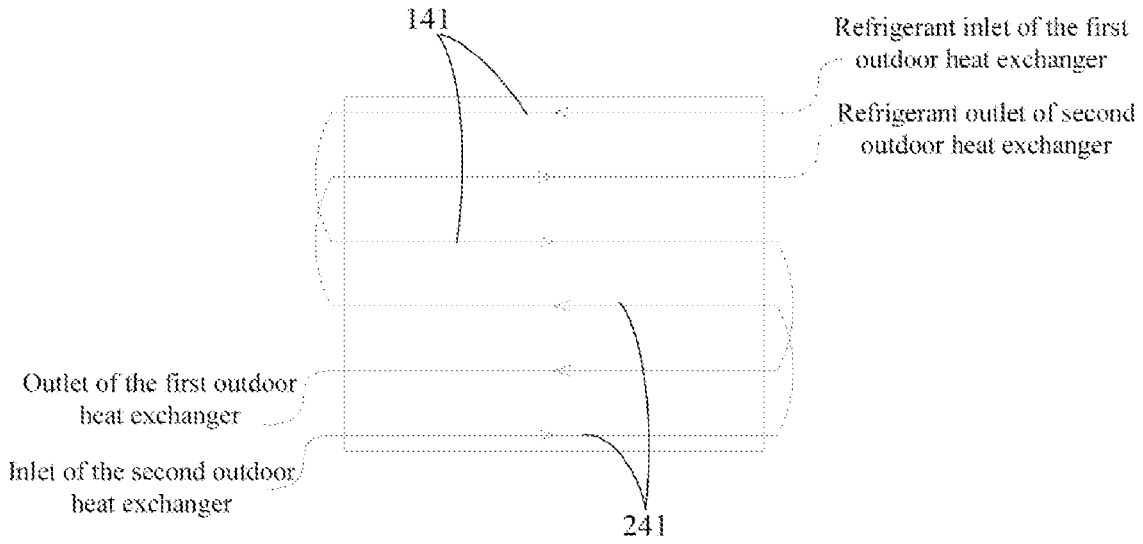
FIG. 2 is a schematic principle structural diagram of an outdoor heat exchanger in one embodiment of the air conditioner of the present disclosure.
Figure 3:
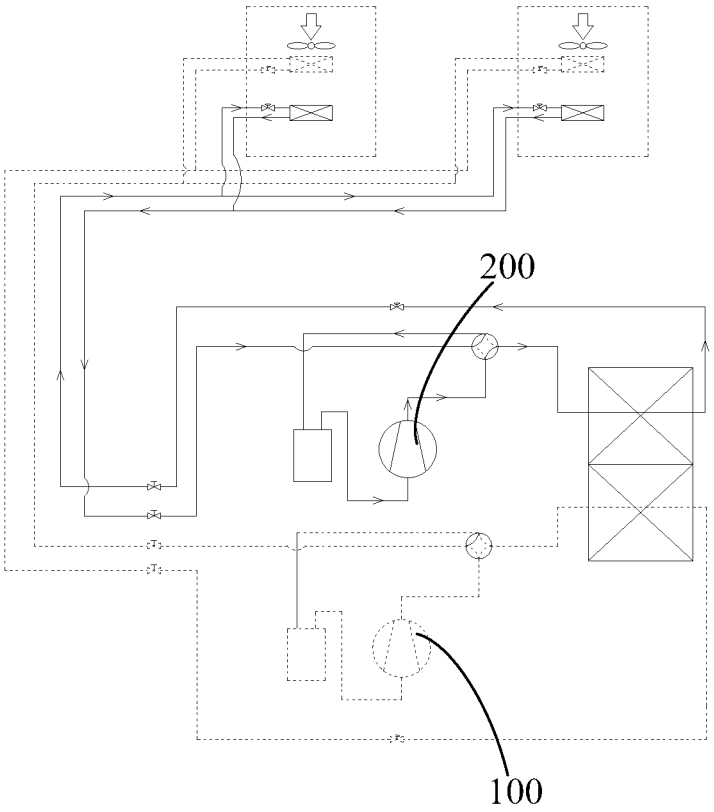
FIG. 3 is a schematic structural diagram showing one embodiment of the air conditioner of the present disclosure in an ordinary refrigerating mode.
Figure 4:
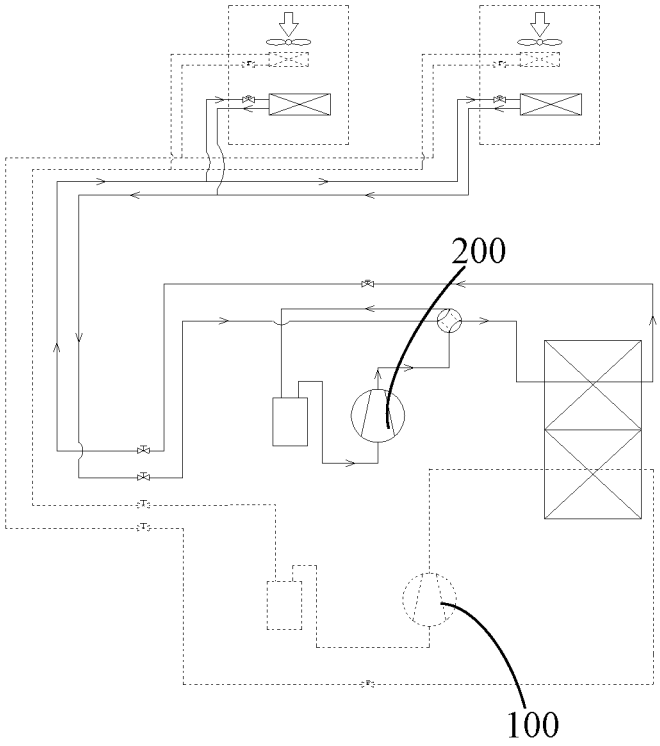
FIG. 4 is a schematic structural diagram showing another embodiment of the air conditioner of the present disclosure in the ordinary refrigerating mode.
Figure 5:
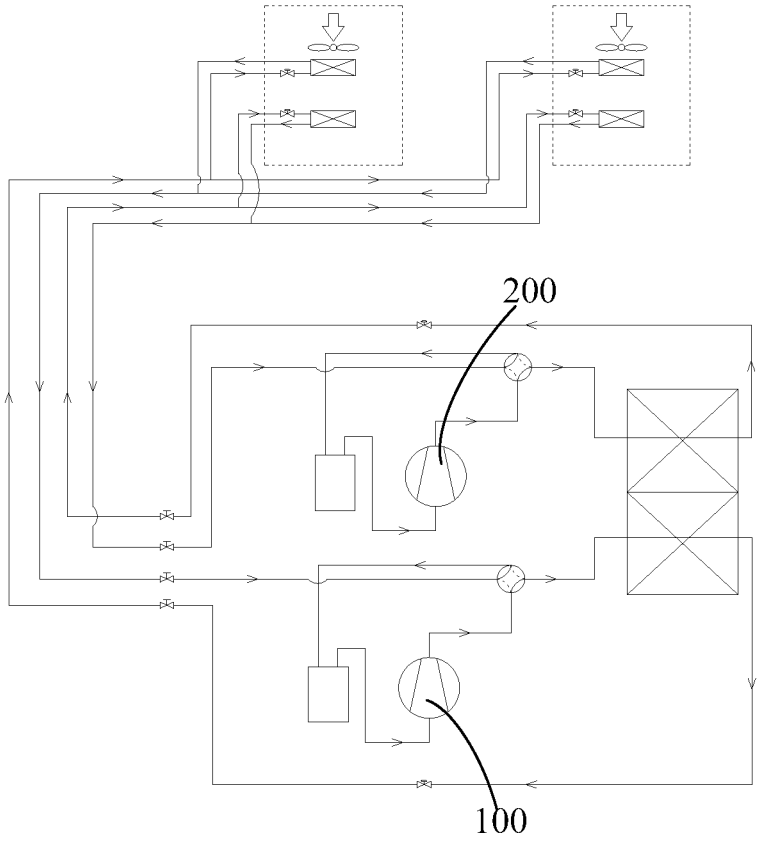
FIG. 5 is a schematic structural diagram showing one embodiment of the air conditioner of the present disclosure in a strong refrigerating mode.
Figure 6:
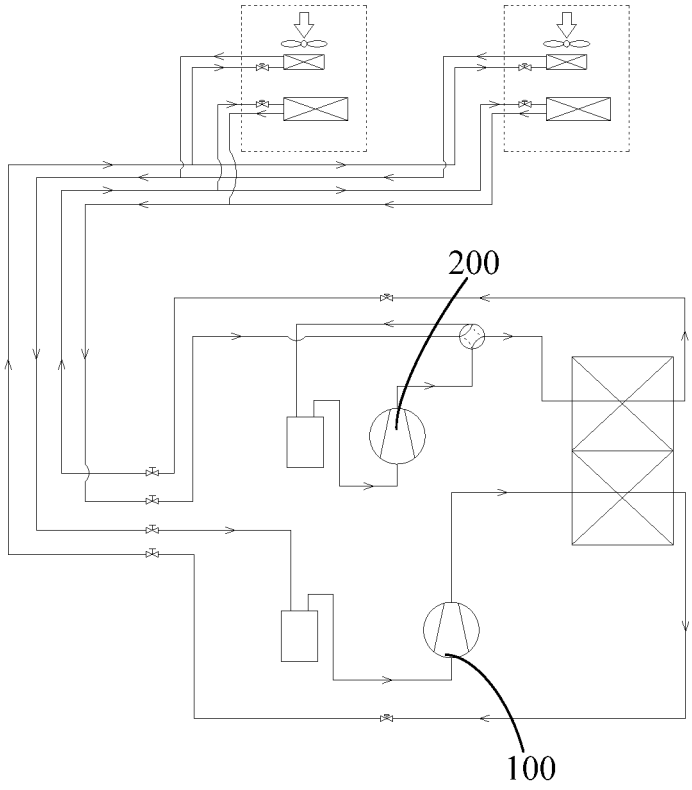
FIG. 6 is a schematic structural diagram showing another embodiment of the air conditioner of the present disclosure in the strong refrigerating mode.
Figure 7:
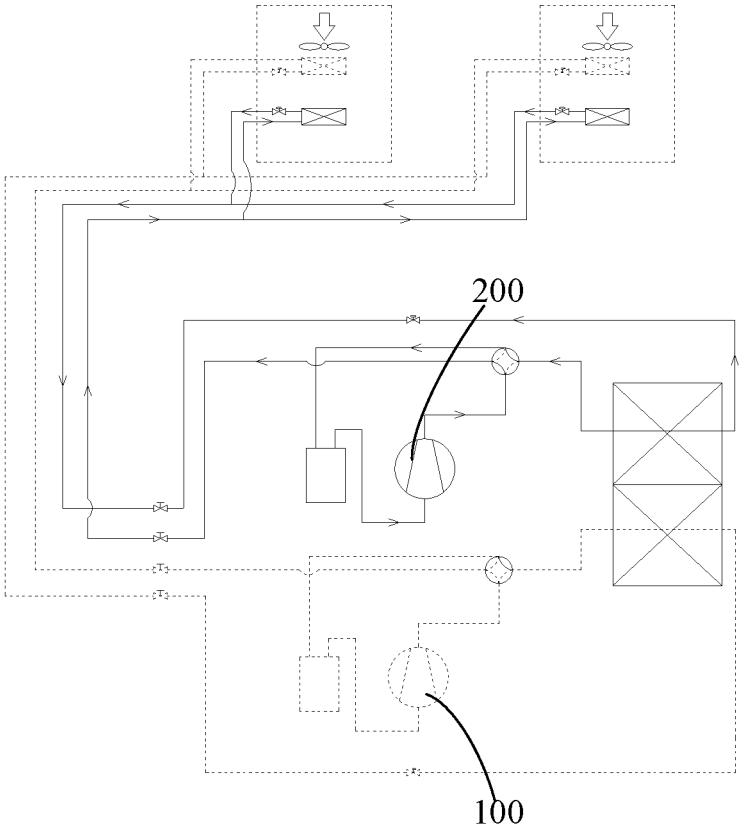
FIG. 7 is a schematic structural diagram showing one embodiment of the air conditioner of the present disclosure in an ordinary heating mode.
Figure 8:
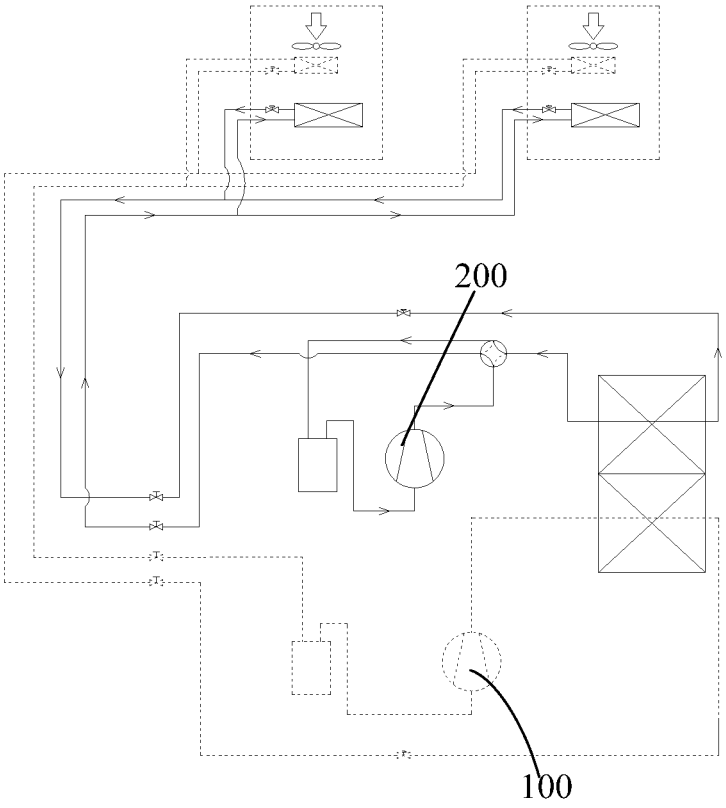
FIG. 8 is a schematic structural diagram showing another embodiment of the air conditioner of the present disclosure in the ordinary heating mode.
Figure 9:
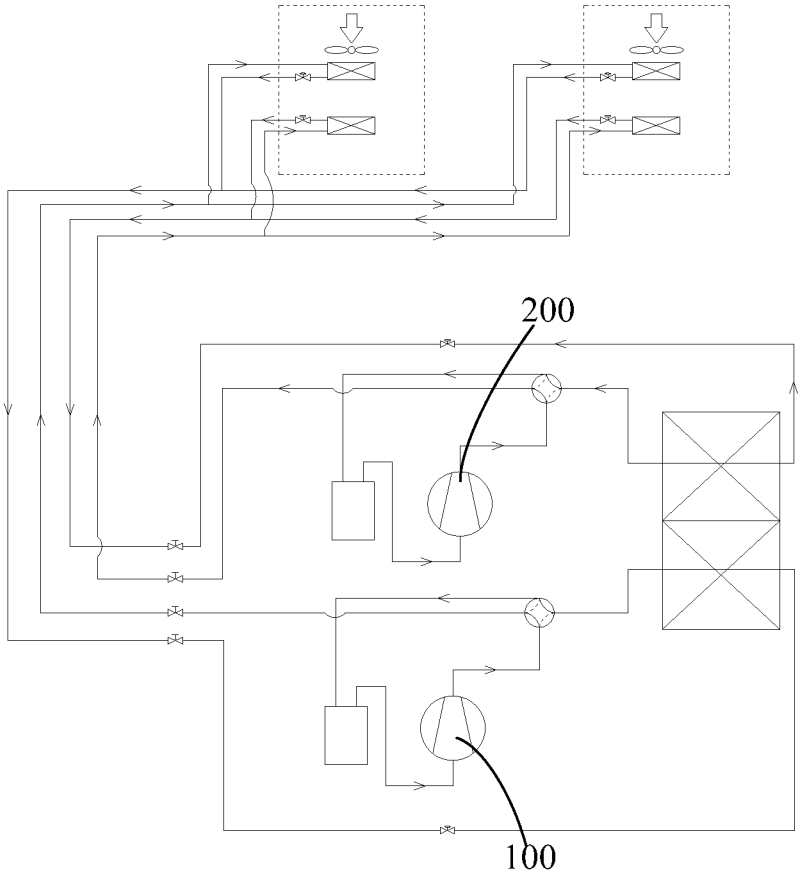
FIG. 9 is a schematic structural diagram showing one embodiment of the air conditioner of the present disclosure in a strong heating mode.
Figure 10:
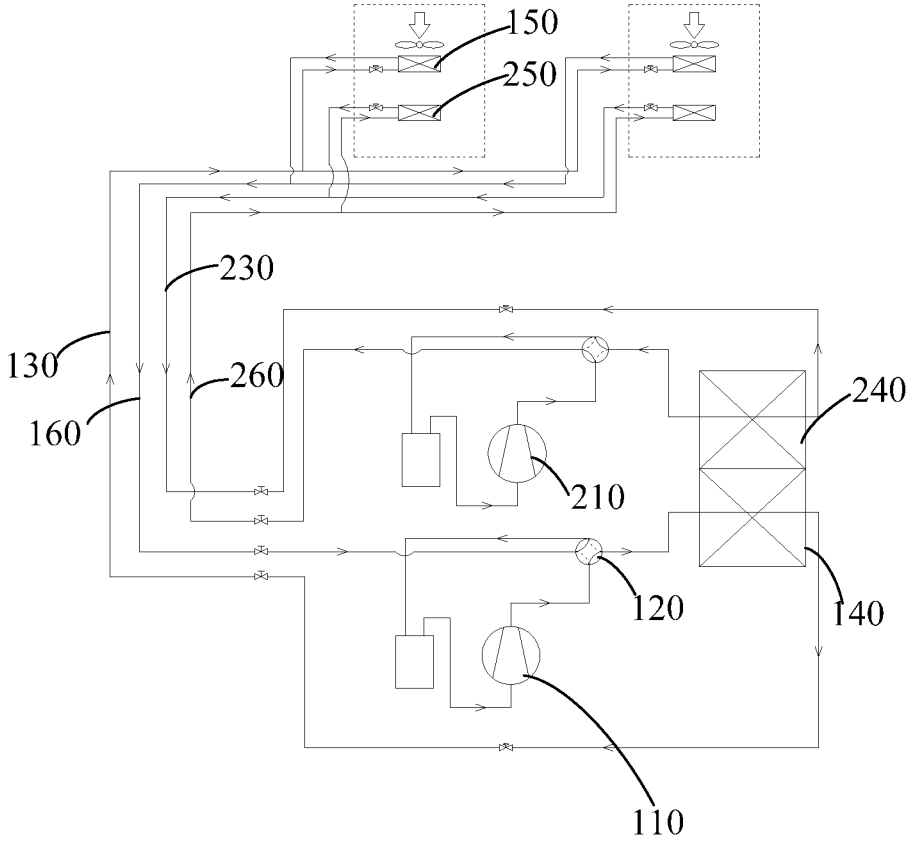
FIG. 10 is a schematic structural diagram showing one embodiment of the air conditioner of the present disclosure in a heating and dehumidification mode.
Figure 11:
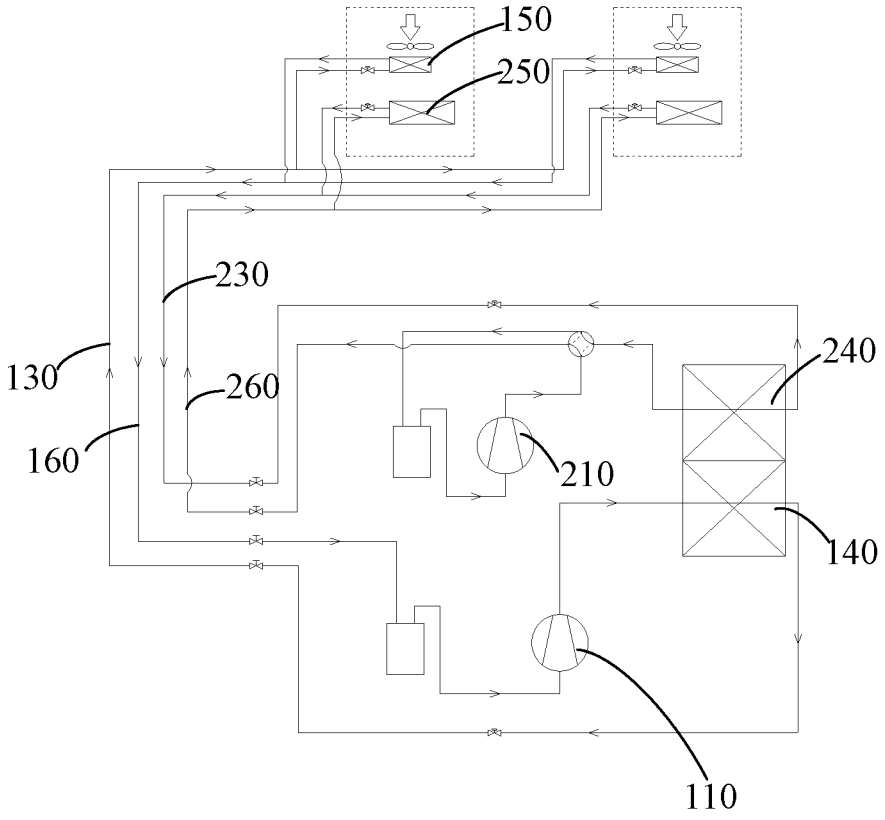
FIG. 11 is a schematic structural diagram of another embodiment of the air conditioner of the present disclosure in the heating and dehumidification mode.
Figure 12:
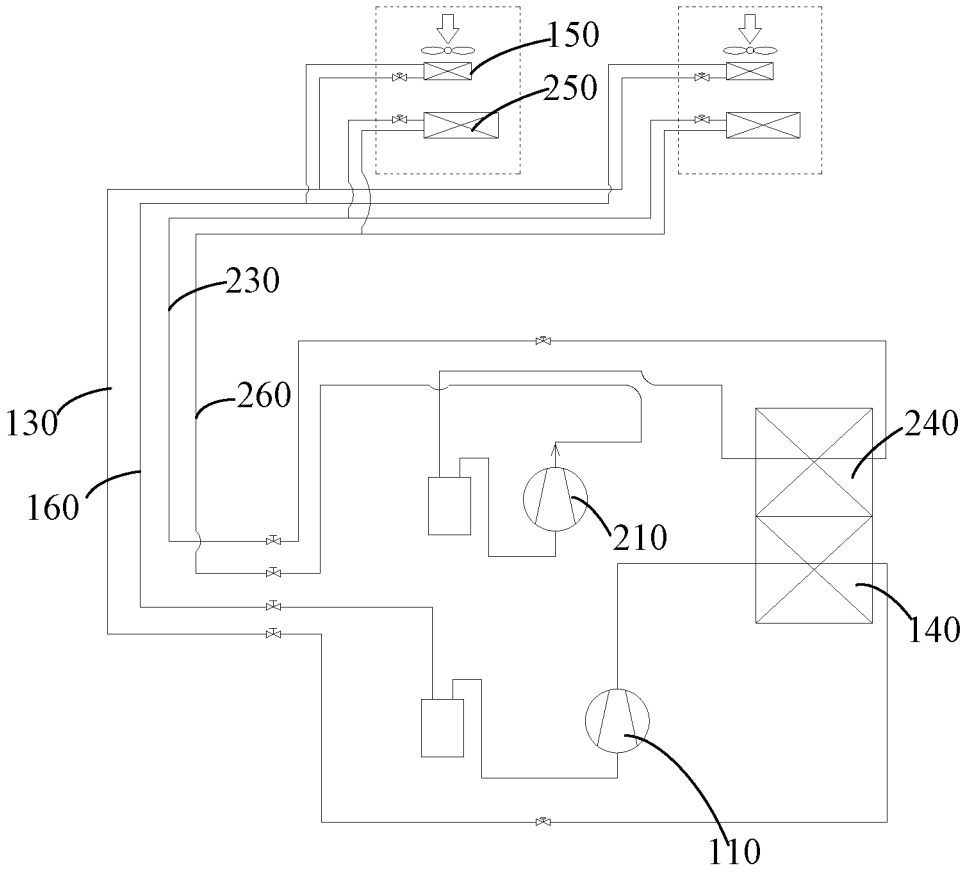
FIG. 12 is a schematic structural diagram of yet another embodiment of the air conditioner of the present disclosure in the heating and dehumidification mode.
Figure 13:
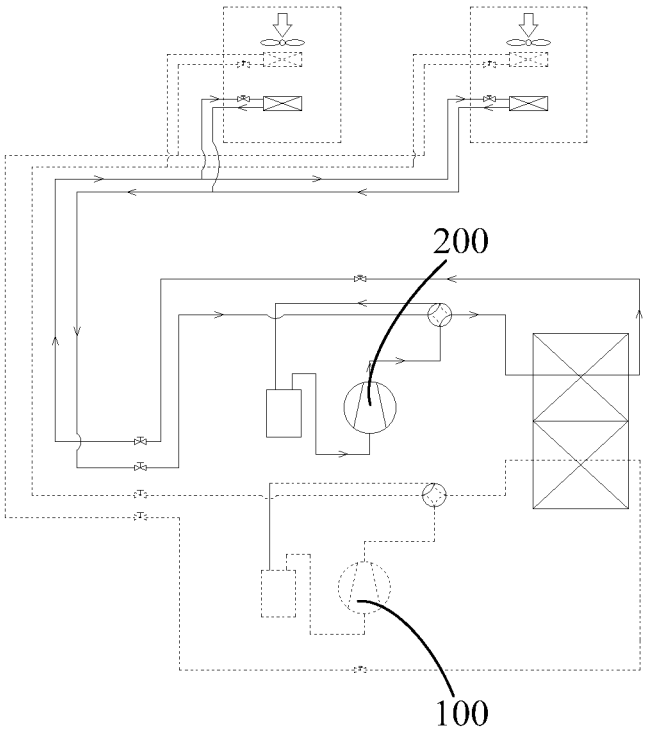
FIG. 13 is a schematic structural diagram showing one embodiment of the air conditioner of the present disclosure in an ordinary defrosting mode.
Figure 14:
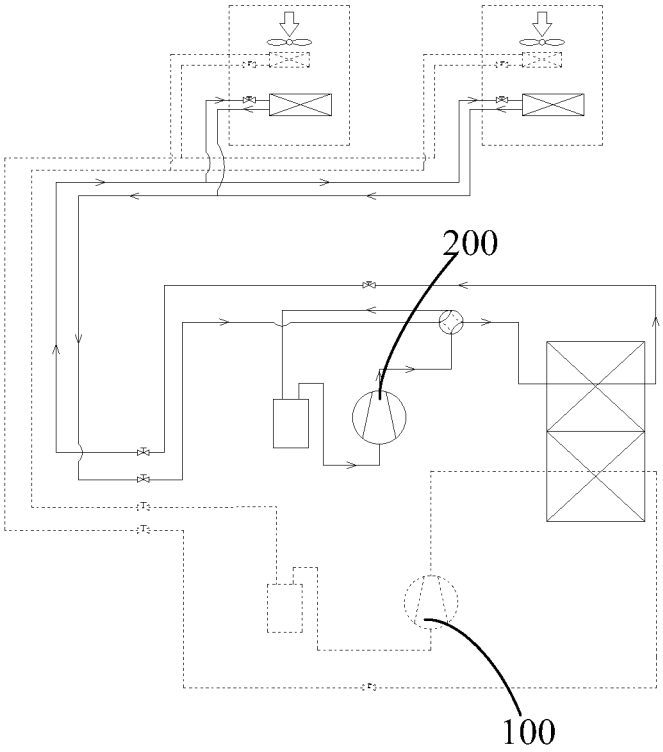
FIG. 14 is a schematic structural diagram showing another embodiment of the air conditioner of the present disclosure in the ordinary defrosting mode.
Figure 15:
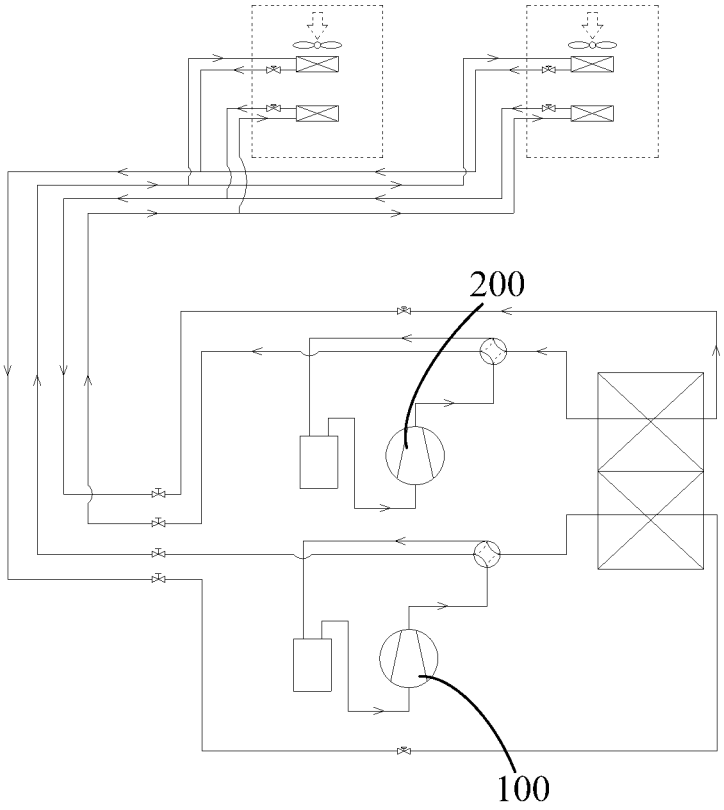
FIG. 15 is a schematic structural diagram showing one embodiment of the air conditioner of the present disclosure in a forced defrosting mode.
Figure 16:
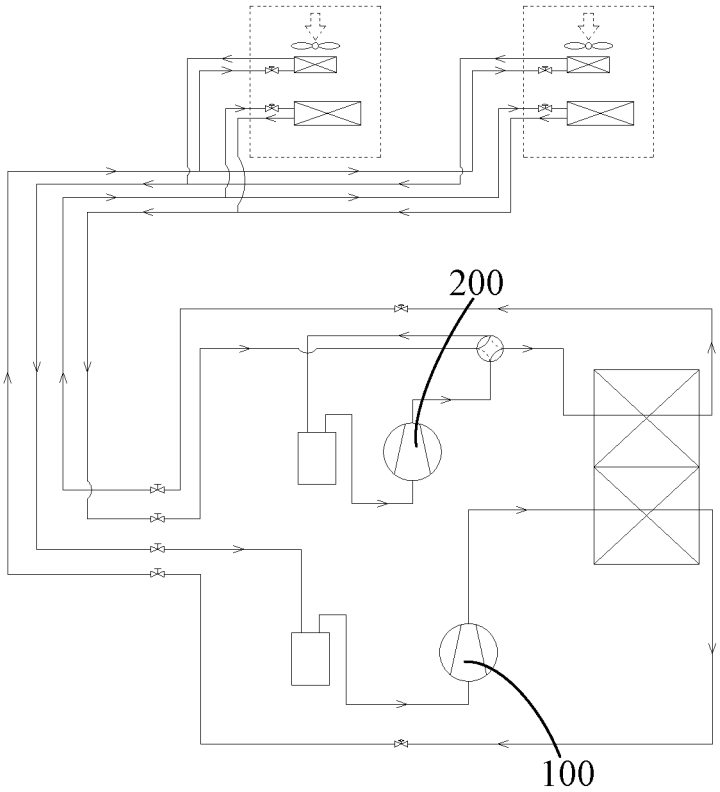
FIG. 16 is a schematic structural diagram showing another embodiment of the air conditioner of the present disclosure in the forced defrosting mode.
Figure 17:
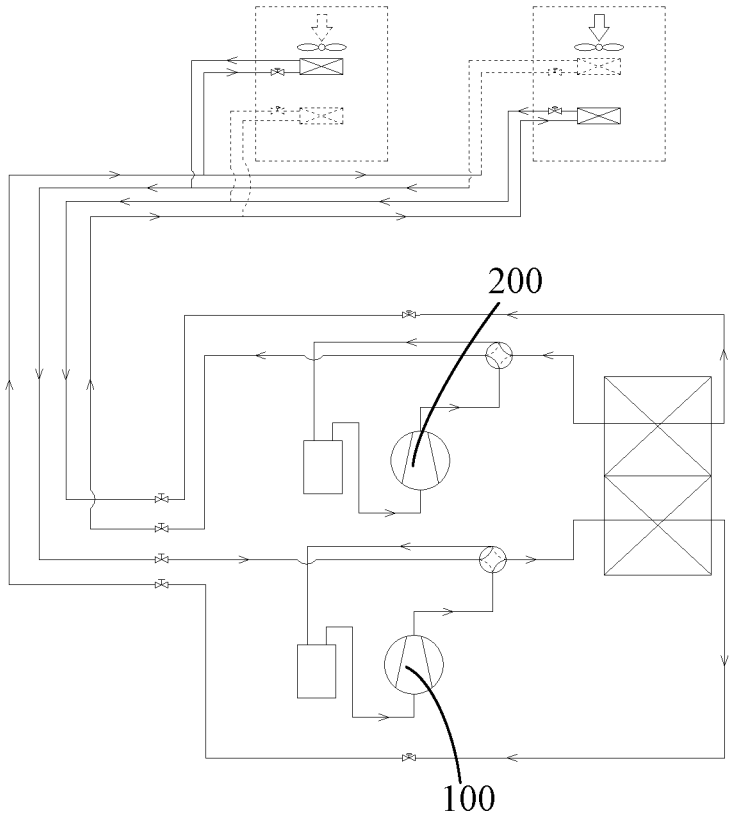
FIG. 17 is a schematic structural diagram showing one embodiment of the air conditioner of the present disclosure in a no-feel defrosting mode.
Figure 18:
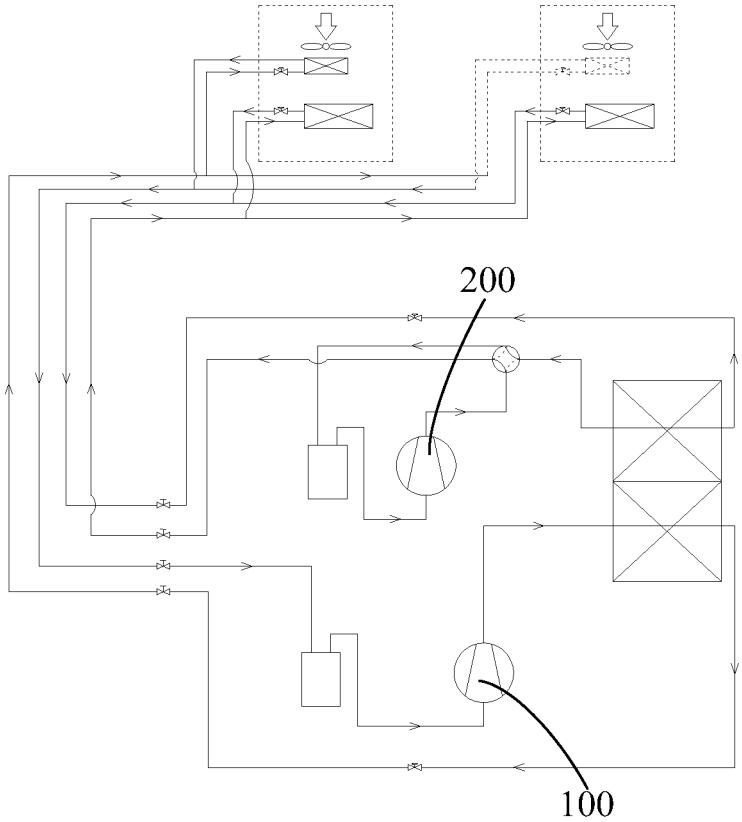
FIG. 18 is a schematic structural diagram showing another embodiment of the air conditioner of the present disclosure in the no-feel defrosting mode.
Figure 19:
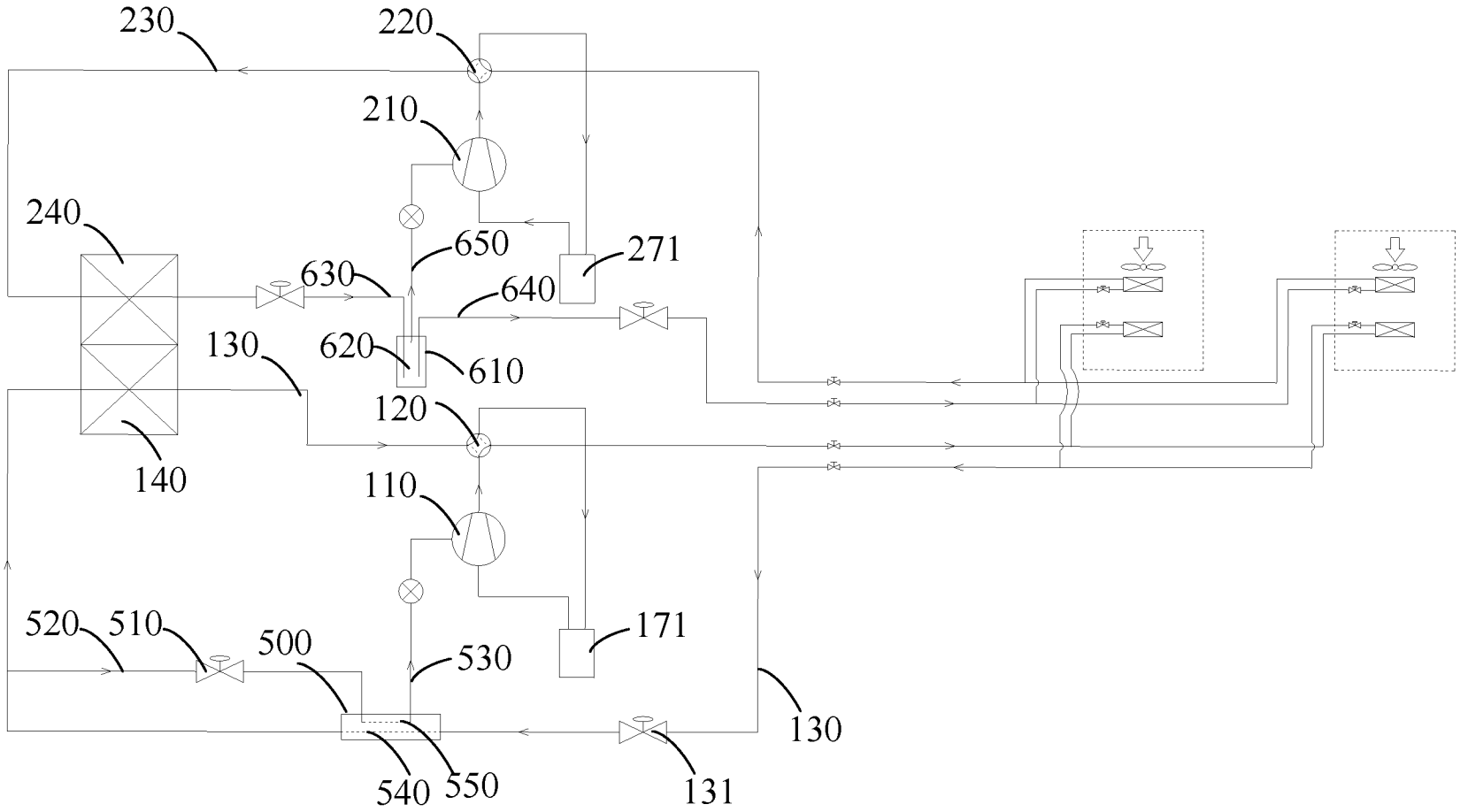
FIG. 19 is a schematic principle structural diagram showing another embodiment of the air conditioner of the present disclosure.

With reference to FIG. 1 to FIG. 2, a whole pipeline structure and component arrangement of the air conditioner are introduced first. In an embodiment of the present disclosure, the air conditioner includes:

a first refrigerant circulation system 100 including:

a first indoor unit and a first outdoor unit, where the first outdoor unit includes a first compressor 110 and a first outdoor heat exchanger 140, and the first indoor unit includes a first indoor heat exchanger 150 and a first indoor throttle device;

a first exhaust pipe 111 arranged at an exhaust port of the first compressor 110, an intake pipe arranged at an intake port of the compressor, and a first liquid-side piping 130 connecting the first exhaust pipe 111, the first outdoor heat exchanger 140, the first indoor throttle device and the first indoor heat exchanger 150 in sequence; and a first gas-side piping 160 connecting the first indoor heat exchanger 150 and the first intake pipe 170;

a second refrigerant circulation system 200 including:

a second indoor unit and a second outdoor unit, where the second outdoor unit includes a second compressor 210 and a second outdoor heat exchanger 240, and the second indoor unit includes a second indoor heat exchanger 250 and a second indoor throttle device;

a second exhaust pipe 211 arranged at an exhaust port of the second compressor 210, an intake pipe arranged at an intake port of the compressor, and a second liquid-side piping 230 connecting the second intake pipe 270, the second outdoor heat exchanger 240, the second indoor throttle device and the second indoor heat exchanger 250 in sequence; and a second gas-side piping 260 connecting the second indoor heat exchanger 250 and the second exhaust pipe 211; and a heat circulation device 300 configured to convey heat energy or cold energy of the first indoor heat exchanger 150 and the second indoor heat exchanger 250 into a room.

Specifically, in the embodiment, in the first refrigerant circulation system 100, the first indoor throttle device 133 may be a throttle valve. Taking an electronic expansion valve or an electric valve as an example, the first indoor throttle device 133 may control a flow volume of a refrigerant flowing into or out of the first indoor heat exchanger 150, and an opening degree of the first indoor throttle device 133 is adjusted according to a refrigerating capacity or a heating capacity (user demand) needed to be released by the first indoor heat exchanger 150. The refrigerant enters the first outdoor heat exchanger 140 to release heat after flowing out of the first compressor 110 through the first exhaust pipe 111, and then enters the first indoor heat exchanger 150 to absorb heat after passing through the first indoor throttle device 133, and the refrigerant returns into the compressor through the first gas-side piping 160 and the first intake pipe 170 after finishing evaporation.

In the second refrigerant circulation system 200, the second indoor throttle device 233 may be a throttle valve. Taking an electronic expansion valve or an electric valve as an example, the second indoor throttle device 233 may control a flow volume of a refrigerant flowing into or out of the second indoor heat exchanger 250, and an opening degree of the second indoor throttle device 233 is adjusted according to a refrigerating capacity or a heating capacity (user demand) needed to be released by the second indoor heat exchanger 250. The refrigerant flows into the second indoor heat exchanger 250 through the second gas-side piping 260 to release heat in the second indoor heat exchanger 250 after flowing out of the second compressor 210 through the second exhaust pipe 211, and then enters the second outdoor heat exchanger 240 to absorb heat after passing through the second indoor throttle device 233, and the refrigerant returns into the compressor through the second liquid-side piping 230 and the second intake pipe 270 after finishing evaporation.

The air conditioner includes two independent refrigerant circulation systems. The first indoor heat exchanger 150 performs refrigeration after the first compressor 110 is operated, and the second indoor heat exchanger 250 performs heating after the second compressor 210 is operated. Under operation of the heat circulation device 300, a refrigerating capacity of the first indoor heat exchanger 150 and a heating capacity of the second indoor heat exchanger 250 are conveyed into a room. When an air flow passes through the first indoor heat exchanger 150, water vapor in the air is condensed, thus reducing moisture in the air and improving dryness of the air. Under an action of the heating capacity, a temperature is increased. In this way, the dryness of the indoor air is improved, and both heat energy and cold energy are received in temperature. The temperature of the air may be adjusted according to demands. If the indoor temperature needs to be increased during dehumidification, a working frequency of the second compressor 210 can be increased, so as to increase a power of the second indoor heat exchanger 250, so that the heating capacity released by the second indoor heat exchanger 250 is greater than the refrigerating capacity released by the first heat exchanger. If it is only needed to keep the temperature during dehumidification, the refrigerating capacity released by the first indoor heat exchanger 150 and the heating capacity released by the second indoor heat exchanger 250 may be set to be equal.

In the embodiment, the first indoor heat exchanger 150 performs dehumidification after the first compressor 110 is operated, the second indoor heat exchanger 250 provides heat energy after the second compressor 210 is operated, then cold energy generated by the first indoor heat exchanger 150 and heat energy generated by the second indoor heat exchanger 250 are conveyed into a room through the heat circulation device 300, and during energy conveying, or after conveying the energy into the room, indoor air can not only be effectively dried, but also be heated by the heat energy. Since the first indoor heat exchanger 150 and the second indoor heat exchanger 250 are in two independent refrigerant systems respectively, power consumptions of the first indoor heat exchanger 150 and the second indoor heat exchanger 250 do not influence each other, and powers of the first compressor 110 and the second compressor 210 may be adjusted respectively according to needs of a user completely, so as to realize dehumidification and reheating, and even heating and dehumidification, thus not only solving humid weather such as "rainy season" for the user, but also greatly improving an adaptability of the air conditioner.

It is worth noting that sizes of the first indoor heat exchanger 150 and the second indoor heat exchanger 250 may be different or the same. When the sizes of the two indoor heat exchangers are equal, a specification of the compressor used in each system may be equal. Moreover, the specification of the compressor may be 20% to 50% smaller than that of a compressor of a machine set with the same load. That is, under the same load, the compressor only needs a specification of 50% to 80%, which is far less than that of the compressor with the same load.

In some embodiments, in order to better mix air passing through the first indoor heat exchanger 150 with air passing through the second indoor heat exchanger 250, the air conditioner includes an indoor casing, and the first indoor heat exchanger 150 and the second indoor heat exchanger 250 are arranged in the indoor casing.

Specifically, in the embodiment, the first indoor heat exchanger 150 and the second indoor heat exchanger 250 are arranged in the same indoor casing, so that the cold energy and the heat energy respectively generated by the first indoor heat exchanger 150 and the second indoor heat exchanger 250 may quickly affect heat-exchanged air. Meanwhile, a compactness of a structure is effectively improved, and a space is fully utilized. There are many ways for the heat energy and the cold energy to enter the room, including a way that air directly passes through the first indoor heat exchanger 150 and the second indoor heat exchanger 250 in sequence, or passes through the second indoor heat exchanger 250 and the first indoor heat exchanger 150 in sequence; and a way that the air passes through the first indoor heat exchanger 150 and the second indoor heat exchanger 250 respectively, and then is mixed. Certainly, liquid may also pass through the indoor heat exchangers, and after heat exchange with the indoor heat exchangers, the liquid conveys the cold energy or the heat energy into air.

A case that the air directly exchanges heat with the indoor heat exchangers is taken as an example. The indoor casing is provided with an air inlet, an air outlet and an air duct connecting the air inlet and the air outlet. The first indoor heat exchanger 150 and the second indoor heat exchanger 250 are arranged in the air duct. The heat circulation device 300 includes a fan, and the fan is arranged in the air duct. The first indoor heat exchanger 150 and the second indoor heat exchanger 250 are arranged in various ways in the air duct. The first indoor heat exchanger and the second indoor heat exchanger may be arranged along a width or height direction of the air duct (up and down) or along an extension direction of the air duct. Taking a case that the first indoor heat exchanger 150 is arranged at a position close to the air inlet and the second indoor heat exchanger 250 is arranged at a position close to the air outlet as an example, in this way, the air flow passes through the first indoor heat exchanger 150 to dehumidify first, and then passes through the second indoor heat exchanger to reheat.

Certainly, in some embodiments, the first indoor heat exchanger 150 and the second indoor heat exchanger 250 may be located in different casings respectively, and fluids (air or liquid) after heat exchange with the first indoor heat exchanger and the second indoor heat exchanger are mixed, or the fluid passes through the first indoor heat exchanger 150 and the second indoor heat exchanger 250 in sequence.

In some embodiments, in order to simplify manufacturing processes of the first outdoor heat exchanger 140 and the second outdoor heat exchanger 240, improve manufacturing efficiencies, and improve heat exchange efficiencies of the first outdoor heat exchanger 140 and the second outdoor heat exchanger 240, the following is implemented.

The air conditioner includes an outdoor casing, and the first outdoor heat exchanger 140 and the second outdoor heat exchanger 240 are arranged in the outdoor casing. The first outdoor heat exchanger 140 and the second outdoor heat exchanger 240 are arranged to be adjacent to each other, so that the first heat exchanger and the second heat exchanger may exchange heat with each other. When only one of the outdoor heat exchangers is operated, the operated heat exchanger may exchange heat through the other heat exchanger, which is beneficial for improving a heat exchange efficiency of the outdoor heat exchanger. When working states of the first outdoor heat exchanger 140 and the second outdoor heat exchanger 240 are opposite, for example, the first outdoor heat exchanger 140 releases heat and the second outdoor heat exchanger 240 absorbs heat, the first outdoor heat exchanger and the second outdoor heat exchanger can further improve their heat exchange efficiencies by each other.

In some embodiments, in order to further improve heat dissipation efficiencies of the first outdoor heat exchanger 140 and the second outdoor heat exchanger 240, the first outdoor heat exchanger 140 and the second outdoor heat exchanger 240 are integrally arranged, and refrigerant pipes of the first outdoor heat exchanger 140 and the second outdoor heat exchanger 240 are arranged in a same fin set. That is, when the outdoor heat exchangers are manufactured, the first outdoor heat exchanger 140 and the second outdoor heat exchanger 240 are manufactured as the same heat exchanger, then a part of the refrigerant pipes is divided into the first outdoor heat exchanger 140, and the other part of the refrigerant pipes is divided into the second outdoor heat exchanger 240. The refrigerant pipes of the first outdoor heat exchanger 140 and the second outdoor heat exchanger 240 share the fin set, so that the refrigerant pipe of the first outdoor heat exchanger 140 and the refrigerant pipe of the second outdoor heat exchanger 240 may both exchange heat through all fins, thus greatly increasing a heat exchange area between the first refrigerant pipe of the first outdoor heat exchanger 140 and the second refrigerant pipe of the second outdoor heat exchanger 240. Meanwhile, rapid heat exchange between the first refrigerant pipe and the second refrigerant pipe may be implemented through the fins, thus greatly increasing a heat exchange rate between the first refrigerant pipe and the second refrigerant pipe.

In some embodiments, in order to further improve the heat exchange efficiencies of the first outdoor heat exchanger 140 and the second outdoor heat exchanger 240, the first outdoor heat exchanger 140 includes a plurality of first refrigerant pipe sections 141 arranged along a height direction of the first heat exchanger, and the second outdoor heat exchanger 240 includes a plurality of second refrigerant pipe sections 241 arranged along a height direction of the second heat exchanger. The first refrigerant pipe sections 141 and the second refrigerant pipe sections 241 are alternately arranged adjacent to each other along the height directions of the outdoor heat exchangers. In the embodiment, the plurality of first refrigerant pipe sections 141 are spliced to form the first refrigerant pipe, and the first refrigerant pipe sections 141 are arranged along one of height, length and width directions of the first outdoor heat exchanger 140. A case that the first refrigerant pipe sections are arranged along the height direction is taken as an example. The first refrigerant pipe sections 141 are horizontally or vertically arranged. A case that the first refrigerant pipe sections are horizontally arranged is taken as an example. Similarly, the plurality of second refrigerant pipe sections 241 are spliced to form the second refrigerant pipe, and the second refrigerant pipe sections 241 are arranged along one of height, length and width directions of the second outdoor heat exchanger 240. A case that the second refrigerant pipe sections are arranged along the height direction is taken as an example. The second refrigerant pipe sections 241 are horizontally or vertically arranged. A case that the second refrigerant pipe sections are horizontally arranged is taken as an example. Projections of the first refrigerant pipe sections 141 and the second refrigerant pipe sections 241 on a horizontal plane may be coincided or have a certain preset gap.

In some embodiments, in order to improve an adaptability of the air conditioner, so that the air conditioner can not only realize dehumidification and reheating, ordinary refrigeration and ordinary heating, but also realize strong refrigeration and strong heating to deal with unexpected accidents, the following is implemented.

In the present disclosure, the first refrigerant circulation system 100 further includes a first reversing device 120. The first reversing device 120 is arranged among the first exhaust pipe 111, the first liquid-side piping 130, the first gas-side piping 160 and the first intake pipe 170, so that the first exhaust pipe 111 is communicated with the first liquid-side piping 130, and the first intake pipe 170 is communicated with the first gas-side piping 160; or, the first exhaust pipe 111 is communicated with the first gas-side piping 160, and the first intake pipe 170 is communicated with the first liquid-side piping 130.

The first reversing device 120 may be a four-way valve or a mechanism capable of adjusting a flow direction of the refrigerant. When the first exhaust pipe 111 is directly communicated with the first indoor heat exchanger 150 through the first gas-side piping 160, the first indoor heat exchanger 150 performs heating. When the first exhaust pipe 111 is communicated with the first outdoor heat exchanger 140 through the first liquid-side piping 130 first, and then communicated with the first indoor heat exchanger 150, the first indoor heat exchanger 150 performs refrigeration. Through arrangement of the first reversing device 120, refrigeration and heating states of the first indoor heat exchanger 150 may be switched at will, so that the first indoor heat exchanger may be fully matched with the second indoor heat exchanger 250 to realize strong heating and other functions.

In the present disclosure, the second refrigerant circulation system 200 further includes a second reversing device 220. The second reversing device 220 is arranged among the second exhaust pipe 211, the second liquid-side piping 230, the second gas-side piping 260 and the second intake pipe 270, so that the second exhaust pipe 211 is communicated with the second liquid-side piping 230, and the second intake pipe 270 is communicated with the second gas-side piping 260; or, the second exhaust pipe 211 is communicated with the second gas-side piping 260, and the second intake pipe 270 is communicated with the second liquid-side piping 230.

The second reversing device 220 may be a four-way valve or a mechanism capable of adjusting a flow direction of the refrigerant. When the second exhaust pipe 211 is directly communicated with the second indoor heat exchanger 250 through the second gas-side piping 260, the second indoor heat exchanger 250 performs heating. When the second exhaust pipe 211 is communicated with the second outdoor heat exchanger 240 through the second liquid-side piping 230 first, and then communicated with the second indoor heat exchanger 250, the second indoor heat exchanger 250 performs refrigeration. Through arrangement of the second reversing device 220, refrigeration and heating states of the second indoor heat exchanger 250 may be switched at will, so that the second indoor heat exchanger may be fully matched with the first indoor heat exchanger 150 to realize strong refrigeration and other functions.

When the first reversing device 120 and the second reversing device 220 are arranged at the same time, the first refrigerant circulation system 100 and the second refrigerant circulation system 200 are two independent multi-functional air-conditioning systems, and may perform refrigeration and heating respectively. When one of the systems fails to be operated, the other system may be immediately operated as a backup system to replace the failed system to operate. Therefore, the dual-system air conditioner in the present application has a backup function, and a reliability of service provided by the air conditioner can be greatly improved. Meanwhile, the air conditioner also provides the user with more temperature demand choices, such as strong refrigeration and strong heating.

In some embodiments, in order to improve working stabilities and performance adjustment of the first refrigerant circulation system 100 and the second refrigerant circulation system 200, the following is implemented.

The first refrigerant circulation system 100 further includes a first outdoor throttle device 131, and the first outdoor throttle device 131 is arranged at the first liquid-side piping 130; and/or, the second refrigerant circulation system 200 further includes a second outdoor throttle device 231, and the second outdoor throttle device 231 is arranged at the second liquid-side piping 230.

In order to better adjust a pressure and a temperature of the refrigerant in the whole first refrigerant circulation system 100, the first refrigerant circulation system 100 further includes the first outdoor throttle device 131, and the first outdoor throttle device 131 is located on the first liquid-side piping 130 between the first outdoor heat exchanger 140 and the first indoor heat exchanger 150. The first outdoor throttle device 131 may only include a first outdoor electronic expansion valve. In some embodiments, the first outdoor throttle device 131 may further include a first stop valve. The first outdoor electronic expansion valve and the first stop valve are arranged at the first liquid-side piping 130 in sequence.

Similarly, in order to better adjust a pressure and a temperature of the refrigerant in the whole second refrigerant circulation system 200, the second refrigerant circulation system 200 further includes the second outdoor throttle device 231, and the second outdoor throttle device 231 is located on the second liquid-side piping 230 between the second outdoor heat exchanger 240 and the second indoor heat exchanger 250. The second outdoor throttle device 231 may only include a second outdoor electronic expansion valve. In some embodiments, the second outdoor throttle device may further include a second stop valve 161. The second outdoor electronic expansion valve and the second stop valve 161 are arranged at the second liquid-side piping 230 in sequence.

In some embodiments, in order to better adjust a working condition of the refrigerant in the refrigerant circulation system, the first gas-side piping 160 and the second gas-side piping 260 are respectively provided with a third stop valve 232 and a fourth stop valve 261.

In some embodiments, in order to ensure stable operations of the first compressor 110 and the second compressor, the first refrigerant circulation system 100 further includes a first gas-liquid separator 171, and the gas-liquid separator 171 is arranged at the first intake pipe 170; and/or, the second refrigerant circulation system 200 further includes a second gas-liquid separator 271, and the second gas-liquid separator 271 is arranged at the second intake pipe 270. The first intake pipe 170 is provided with the first gas-liquid separator 171, and the second intake pipe 270 is provided with the second gas-liquid separator 271. When the refrigerant enters the gas-liquid separator, the liquid refrigerant remains in the gas-liquid separator, and the gas refrigerant returns to the compressor for compression. In this way, the liquid refrigerant is avoided from entering the compressor, thus avoiding a liquid impact on the compressor during compression, which is beneficial for improving a service life and a working stability of the compressor.

In some embodiments, the first refrigerant circulation system 100 further includes a plurality of first indoor units, and the first indoor units may include different forms of heat exchangers, such as an ordinary refrigerating/heating internal machine or an internal machine capable of switching between refrigeration and heating states at will with a switching device. In this way, the first refrigerant circulation system 100 may respectively realize mixed operations such as refrigeration and heating in different indoor units at the same time.

Specifically, the first refrigerant circulation system 100 further includes: a first connection pipe branched from the first gas-side piping 160, and a second connection pipe 162 branched from the first liquid-side piping 130. The first refrigerant circulation system 100 further includes the plurality of first indoor units, and the plurality of first indoor units are connected in parallel onto the first connection pipe and the second connection pipe 162. In this way, the plurality of first indoor units in the first refrigerant circulation system 100 are connected in parallel, so that the first refrigerant circulation system 100 may provide heat energy or cold energy for a plurality of rooms at the same time.

Similarly, in some embodiments, the second refrigerant circulation system 200 further includes a plurality of second indoor units, and the second indoor units may include different forms of heat exchangers, such as an ordinary refrigerating/heating internal machine or an internal machine capable of switching between refrigeration and heating states at will with a switching device. In this way, the second refrigerant circulation system 200 may respectively realize mixed operations such as refrigeration and heating in different indoor units at the same time.

Specifically, the second refrigerant circulation system 200 further includes: a third connection pipe 234 branched from the second gas-side piping 260, and a fourth connection pipe 262 branched from the second liquid-side piping 230. The second refrigerant circulation system 200 further includes the plurality of second indoor units, and the plurality of second indoor units are connected in parallel onto the third connection pipe and the fourth connection pipe 262.

It is worth noting that all the first indoor units include the first indoor heat exchanger 150 and the first indoor throttle device. The first indoor throttle device controls a working state of the first indoor heat exchanger 150. When a certain first indoor throttle device is completely turned off, a corresponding first indoor heat exchanger 150 stops operating. Similarly, each second indoor throttle device controls a working state of the second indoor heat exchanger 250. When a certain second indoor throttle device is completely turned off, a corresponding second indoor heat exchanger 250 stops operating. In this way, each first indoor unit and each second indoor unit may be independently controlled, which is beneficial for different rooms to implement different working modes, thus providing personalized services for the user.

In some embodiments, the air conditioner may also be configured to prepare hot water or cold water. The air conditioner further includes a water treatment device, the water treatment device includes a water heat exchanger and a water container, and the water heat exchanger is configured to heat or refrigerate water in the water container.

The first refrigerant circulation system 100 further includes: a first connection pipe branched from the first gas-side piping 160, and a second connection pipe 162 branched from the first liquid-side piping 130, and the water heat exchanger and the first indoor unit are connected in parallel onto the first connection pipe and the second connection pipe 162; and/or, the second refrigerant circulation system 200 further includes: a third connection pipe 234 branched from the second gas-side piping 260, and a fourth connection pipe 262 branched from the second liquid-side piping 230, and the water heat exchanger and the second indoor unit are connected in parallel onto the third connection pipe 234 and the fourth connection pipe 262.

The heat exchanger may be connected in the first refrigerant circulation system 100 or the second refrigerant circulation system 200. When there are a plurality of water heat exchangers, a part of the water heat exchangers are arranged in the first refrigerant circulation system 100, and the other part of the water heat exchangers are arranged in the second refrigerant circulation system 200. Certainly, there may be a plurality of water containers, and in this way, one water container may be filled with hot water, and the other water container is filled with cold water, so that the cold water and the hot water may be supplied at the same time. When the hot water needs to be prepared, a high-temperature refrigerant passes through the water heat exchanger to convey heat energy to water in the container. When the cold water needs to be prepared, a low-temperature refrigerant passes through the water heat exchanger to convey cold energy to water in the container.

In some embodiments, the air conditioner is also configured to supply water for floor-heating.

The air conditioner further includes a heat exchange water tank and a floor-heating water flow pipe communicated with the heat exchange water tank, and a floor-heating heat exchanger is arranged in the heat exchange water tank.

The first refrigerant circulation system 100 further includes: a first connection pipe branched from the first gas-side piping 160, and a second connection pipe 162 branched from the first liquid-side piping 130, and the floor-heating heat exchanger and the first indoor unit are connected in parallel onto the first connection pipe and the second connection pipe 162; and/or, the second refrigerant circulation system 200 further includes: a third connection pipe 234 branched from the second gas-side piping 260, and a fourth connection pipe 262 branched from the second liquid-side piping 230, and the floor-heating heat exchanger and the second indoor unit are connected in parallel onto the third connection pipe 234 and the fourth connection pipe 262.

The floor heat exchanger may not only be arranged in the first refrigerant circulation system 100, but also be arranged in the second refrigerant circulation system 200. Certainly, the floor heat exchanger may be arranged in the first refrigerant circulation system 100 and the second refrigerant circulation system 200 at the same time. Specifically, in the embodiment, the floor-heating water flow pipe may be buried in a ground or a wall, the floor-heating water flow pipe is communicated with the heat exchange water tank, and the water in the heat exchange water tank may circulate in the floor-heating water flow pipe, so that a water temperature in the floor-heating water flow pipe is equivalent to that in the heat exchange water tank. When a high-temperature and high-pressure refrigerant passes through the floor-heating heat exchanger, the floor-heating heat exchanger exchanges heat with the water in the heat exchange water tank to heat the cold water in the water tank. When a low-pressure refrigerant passes through the floor-heating heat exchanger, the floor-heating heat exchanger exchanges heat with the water in the heat exchange tank to refrigerate the water in the heat exchange tank.

In some embodiments, in order to improve a heating effect of the air conditioner and eliminate abnormal sound during refrigeration, the first refrigerant circulation system and the second refrigerant circulation system are also respectively provided with a first economizer and a second economizer. Detailed descriptions are as follows.

The first refrigerant circulation system further includes a first gas-liquid separator and the first economizer, and the first gas-liquid separator is arranged at the first intake pipe. The first economizer is arranged at the first liquid-side piping between the first outdoor heat exchanger and the first indoor throttle device, and a first return pipe of the first economizer is communicated with the first gas-liquid separator.

When the air conditioner performs refrigeration, the refrigerant passes through the first outdoor heat exchanger first, and then passes through the first economizer for further condensation and heat exchange, and then a gas-phase and liquid-phase refrigerant becomes a pure liquid refrigerant. This part of pure liquid refrigerant flows into a room, passes through the first throttle valve, and then enters the first indoor heat exchanger for heat absorption and evaporation. Since a state of the refrigerant entering the first throttle valve is changed from a gas-phase and liquid-phase state to a pure liquid state, a problem of abnormal sound of the refrigerant caused by the gas-phase and liquid-phase refrigerant passing through the throttle device is solved.

The first compressor is an enthalpy-increasing compressor, and the first return pipe includes a first return pipe body, and a first communicating pipe and a second communicating pipe which are respectively communicated with the first return pipe body. One end of the first communicating pipe far away from the first return pipe body is communicated with the first gas-liquid separator. One end of the second communicating pipe far away from the first return pipe body is communicated with a medium-pressure air return port of the first compressor.

After throttled and depressurized by a liquid taking throttle valve, the refrigerant passes through a liquid taking pipe and then enters the first economizer for heat absorption and evaporation. Evaporated medium-pressure saturated vapor passes through the first return pipe and the second connection pipe and then enters a medium-pressure intake port of the first compressor, and is mixed with the refrigerant at a low-pressure intake port of the first compressor and compressed together, thus solving problems of a low flow volume of the refrigerant, a low return pressure and a high compression ratio in a low-temperature environment, and improving a low-temperature heating capacity and a reliability of the system. According to the technology of the present disclosure, when an outdoor ambient temperature is low, an intake amount of the refrigerant of the first compressor in a low-temperature environment is increased by system design of the first air injection enthalpy-increasing compressor and the first economizer, so that the low-temperature heating capacity is improved. Meanwhile, the compression ratio in the low-temperature environment is reduced, which can improve the reliability of the system.

The first communicating pipe or the first return pipe is provided with a first control valve. The second communicating pipe is provided with a second control valve. When the first return pipe is only communicated with the gas-liquid separator, the first control valve is arranged at the first return pipe to control turning on and turning off of the first return pipe. When the first return pipe is communicated with the first gas-liquid separator through the first communicating pipe, and the second communicating pipe is communicated with the first compressor, the first control valve is arranged at the first communicating pipe. In some embodiments, in order to ensure reliable flow of the refrigerant, the second communicating pipe is provided with the second control valve.

The second refrigerant circulation system further includes a second gas-liquid separator and the second economizer, and the second gas-liquid separator is arranged at the second intake pipe. The second economizer is arranged at the second liquid-side piping between the second outdoor heat exchanger and the second indoor throttle device, and a second return pipe of the second economizer is communicated with the second gas-liquid separator.

When the air conditioner performs refrigeration, the refrigerant passes through the first outdoor heat exchanger first, and then passes through the first economizer for further condensation and heat exchange, and then a gas-phase and liquid-phase refrigerant becomes a pure liquid refrigerant. This part of pure liquid refrigerant flows into a room, passes through the second throttle valve, and then enters the second indoor heat exchanger for heat absorption and evaporation. Since a state of the refrigerant entering the second throttle valve is changed from a gas-phase and liquid-phase state to a pure liquid state, a problem of abnormal sound of the refrigerant caused by the gas-phase and liquid-phase refrigerant passing through the throttle device is solved.

The second compressor is an enthalpy-increasing compressor, and the second return pipe includes a second return pipe body, and a third communicating pipe and a fourth communicating pipe which are respectively communicated with the second return pipe body.

One end of the third communicating pipe far away from the second return pipe body is communicated with the second gas-liquid separator. One end of the fourth communicating pipe far away from the second return pipe body is communicated with a medium-pressure air return port of the second compressor.

After throttled and depressurized by a liquid taking throttle valve, the refrigerant passes through a liquid taking pipe and then enters the second economizer for heat absorption and evaporation. Evaporated medium-pressure saturated vapor passes through the second return pipe and the fourth connection pipe and then enters a medium-pressure intake port of the second compressor, and is mixed with the refrigerant at a low-pressure intake port of the second compressor and compressed together, thus solving problems of a low flow volume of the refrigerant, a low return pressure and a high compression ratio in a low-temperature environment, and improving a low-temperature heating capacity and a reliability of the system. According to the technology of the present disclosure, when an outdoor ambient temperature is low, an intake amount of the refrigerant of the second compressor in a low-temperature environment is increased by system design of the second air injection enthalpy-increasing compressor and the second economizer, so that the low-temperature heating capacity is improved. Meanwhile, the compression ratio in the low-temperature environment is reduced, which can improve the reliability of the system.

The third communicating pipe is provided with a third control valve. The fourth communicating pipe is provided with a fourth control valve. When the second return pipe is only communicated with the gas-liquid separator, the third control valve is arranged at the second return pipe to control turning on and turning off of the third return pipe. When the second return pipe is communicated with the second gas-liquid separator through the third communicating pipe, and the fourth communicating pipe is communicated with the second compressor, the third control valve is arranged at the third communicating pipe. In some embodiments, in order to ensure reliable flow of the refrigerant, the fourth communicating pipe is provided with the fourth control valve.

In some embodiments, in order to improve performances of the air conditioner, the first compressor is an enthalpy-increasing compressor, and the first compressor is provided with a medium-pressure intake port; the first liquid-side piping is provided with a first outdoor throttle device; and the first liquid-side piping between the first outdoor throttle device and the first outdoor heat exchanger is provided with an economizer 500 or a flash evaporator 600; and/or, the second compressor is an enthalpy-increasing compressor, and the second compressor is provided with a medium-pressure intake port; the second liquid-side piping is provided with a second outdoor throttle device; and the second liquid-side piping between the second outdoor throttle device and the second outdoor heat exchanger is provided with an economizer 500 or a flash evaporator 600.

That is, the first liquid-side piping may be provided with the economizer 500 or the flash evaporator 600. The second liquid side piping may be provided with the economizer 500 or the flash evaporator 600. More specifically, the economizer in the first refrigerant circulation system may be a first economizer, and the flash evaporator may be a first flash evaporator. The economizer in the second refrigerant circulation system can be a second economizer, and the flash evaporator may be a second flash evaporator.

By arrangement of the economizer 500 and the flash evaporator 600, the gas refrigerant may return to the compressor through the medium-pressure intake port of the compressor, thus improving a capacity of the compressor.

A first refrigerant flow path 540 and a second refrigerant flow path 550 are arranged in the economizer 500, and two ends of the first refrigerant flow path 540 are respectively communicated with the liquid-side pipings at two ends of the economizer 500. One end of the second refrigerant flow path 550 is communicated with the liquid-side piping through a liquid taking pipe 520, and the other end of the second refrigerant flow path is communicated with the medium-pressure intake port of the compressor through a return pipe 530. The liquid taking pipe 520 is provided with a liquid taking throttle valve 510. An inflow end of the liquid taking pipe 520 is communicated with the liquid-side piping between the economizer 500 and the outdoor heat exchanger, or the inflow end of the liquid taking pipe 520 is communicated with the liquid-side piping between the economizer 500 and the outdoor throttle device. The return pipe 530 of the economizer 500 is communicated with the medium-pressure intake port of the compressor.

The economizer 500 itself has a throttling function. The first refrigerant flow path 540 and the second refrigerant flow path 550 are arranged in the economizer 500, and two ends of the first refrigerant flow path 540 are respectively communicated with the liquid-side pipings at two ends of the economizer 500. One end of the second refrigerant flow path 550 is communicated with the liquid-side piping through the liquid taking pipe 520, and the other end of the second refrigerant flow path is communicated with the medium-pressure intake port of the compressor through the return pipe 530. The liquid taking pipe 520 is provided with the liquid taking throttle valve 510. One end of the first refrigerant flow path is communicated with a refrigerant inlet of the economizer 500, and the other end of the first refrigerant flow path is communicated with a refrigerant outlet of the economizer 500. One end of the liquid taking pipe 520 is communicated with the liquid-side piping, and the other end of the liquid taking pipe is communicated with the second refrigerant flow path 550. One end of the return pipe 530 is communicated with the medium-pressure intake port of the compressor, and the other end of the return pipe is communicated with the second refrigerant flow path 550. The return pipe 530 may be provided with a control valve to control turning on and turning off of the return pipe 530.

The flash evaporator 600 includes: a cylinder 610, the cylinder 610 being provided with a flash evaporation cavity 620; a first liquid-phase refrigerant pipeline 630, the first liquid-phase refrigerant pipeline 630 being fixed at a first end of the cylinder 610 and communicated with the flash evaporation cavity 620 through first liquid inlet and outlet; a second liquid-phase refrigerant pipeline 640, the second liquid-phase refrigerant pipeline 640 being fixed at a second end of the cylinder 610 opposite to the first end of the cylinder and communicated with the flash evaporation cavity 620 through second liquid inlet and outlet; and a gas-phase refrigerant pipeline 650, the gas-phase refrigerant pipeline 650 being fixed at the first end of the cylinder 610 and communicated with the flash evaporation cavity 620 through a gas outlet. The other end of the first liquid-phase refrigerant pipeline 630 is communicated with a first outdoor machine, the other end of the second liquid-phase refrigerant pipeline is communicated with the first outdoor throttle device, and the other end of the gas-phase refrigerant pipeline is communicated with the medium-pressure intake port of the compressor. The gas-phase refrigerant pipeline may be provided with a control valve to control turning on and turning off of the gas-phase refrigerant pipeline 650.

The above air conditioner has different operation modes according to different customer demands, and under different operation modes, the air conditioner has different control ways for the first refrigerant circulation system 100 and the second refrigerant circulation system 200. Operation and control logics of the air conditioner are generally described first, and then described in a refrigerating mode, a heating mode, a dehumidification and reheating mode and a defrosting mode respectively hereinafter.

A control method for the air conditioner includes the following steps.

In S10, a mode control instruction is acquired.

The mode control instruction may be sent from an outside of the air conditioner, such as a remote controller and a mobile terminal including a mobile phone, or may be judged by the air conditioner after detection. For example, when the air conditioner detects that a humidity of a current indoor environment is greater than a preset value of the system or a preset value of the user, the air conditioner performs dehumidification. The mode control instruction includes an ordinary refrigerating mode instruction, a strong refrigerating mode instruction, an ordinary heating mode instruction, a strong heating mode instruction, an ordinary dehumidification mode instruction, a dehumidification and reheating mode instruction, an ordinary defrosting mode instruction, a strong defrosting mode instruction, and a no-feel defrosting mode instruction.

In S20, working demands of the first indoor heat exchanger 151 and the second indoor heat exchanger 250 are acquired according to the mode control instruction.

In S30, a first refrigerant circulation system 100 and a second refrigerant circulation system 200 are operated according to the working demands of the first indoor heat exchanger 151 and the second indoor heat exchanger 250.

After acquiring the mode instruction, working state demands of the first indoor heat exchanger 150 and the second indoor heat exchanger 250 are acquired according to mode instruction demands. Then, working states of components in the first refrigerant circulation system 100 and the second refrigerant circulation system 200 are controlled according to the working state demands of the first indoor heat exchanger 150 and the second indoor heat exchanger 250, so that working states of the first indoor heat exchanger 150 and the second indoor heat exchanger 250 meet the requirements.

Detailed descriptions are made respectively hereinafter.

In the refrigerating mode:

The step of acquiring the working demands of the first indoor heat exchanger 151 and the second indoor heat exchanger 250 according to the mode control instruction includes:

determining that the mode control instruction is the refrigerating mode instruction; and controlling the first indoor heat exchanger 150 and/or the second indoor heat exchanger 250 to refrigerate.

Specifically, in the embodiment, when the air conditioner determines that the currently acquired control instruction is the refrigerating mode for refrigeration, the first indoor heat exchanger 150 is controlled to refrigerate, or the second indoor heat exchanger 250 is controlled to refrigerate, or the first indoor heat exchanger 150 and the second indoor heat exchanger 250 are controlled to refrigerate at the same time.

Specifically, how to realize accurate control needs further analysis at the moment. The step of controlling the first indoor heat exchanger 150 and/or the second indoor heat exchanger 250 to refrigerate includes the followings.

A refrigerating capacity demand in the refrigerating mode is acquired.

In order to acquire the refrigerating capacity demand, it is needed to acquire a target temperature of the user, a current indoor temperature and an outdoor ambient temperature. According to the target temperature, the current indoor temperature and the outdoor ambient temperature, a refrigerating capacity needed to reduce the current indoor temperature to the target temperature, or a refrigerating capacity needed to be provided per unit time is calculated, which is namely the refrigerating capacity needed to be provided by the first indoor heat exchanger 150 and the second indoor heat exchanger 250 jointly, or the refrigerating capacity needed to be provided per unit time.

A calculated working frequency needed by a single compressor is calculated according to the refrigerating capacity demand.

According to the refrigerating capacity demand, when all the refrigerating capacity is provided by one indoor heat exchanger, a working frequency (the calculated working frequency) needed by the compressor is calculated, which is namely the working frequency needed by the compressor when the refrigerating capacity is provided by one compressor.

Moreover, the calculated working frequency is compared with a first preset frequency range.

A minimum value of the first preset frequency range is greater than zero, and a maximum value of the first preset frequency range is between 75% and 92% of a full-load working frequency of the compressor. Generally, the calculated working frequency is greater than zero, and the calculated working frequency is mainly compared with the maximum value of the first preset frequency range.

It is determined that the calculated working frequency is in the first preset frequency range, and the first indoor heat exchanger 150 or the second indoor heat exchanger 250 is controlled to refrigerate.

When the calculated working frequency is less than or equal to the maximum value of the first preset frequency range, the calculated working frequency is in the first preset frequency range. The first indoor heat exchanger and 150 or the second indoor heat exchanger 250 is independently controlled to refrigerate.

When the calculated working frequency is greater than the maximum value of the first preset frequency range, it is determined that the calculated working frequency is out of the preset frequency range, and the first indoor heat exchanger 150 and the second indoor heat exchanger 250 are controlled to refrigerate. That is, a single refrigerant circulation system can no longer meet a supply demand of cold energy. It is needed to start the first refrigerant circulation system 100 and the second refrigerant circulation system 200 at the same time. As for load distributions of the first refrigerant circulation system 100 and the second refrigerant circulation system 200, a case that the working frequency of the first compressor 110 is equivalent to the working frequency of the second compressor 210 is taken as an example.

In the heating mode:

The step of acquiring the working demands of the first indoor heat exchanger 151 and the second indoor heat exchanger 250 according to the mode control instruction includes the followings.

It is determined that the mode control instruction is the heating mode instruction.

The first indoor heat exchanger 150 and/or the second indoor heat exchanger 250 are controlled to heat.

Specifically, in the embodiment, when the air conditioner determines that the currently acquired control instruction is the heating mode for heating, the first indoor heat exchanger 150 is controlled to heat, or the second indoor heat exchanger 250 is controlled to heat, or the first indoor heat exchanger 150 and the second indoor heat exchanger 250 are controlled to heat at the same time.

Specifically, how to realize accurate control needs further analysis at the moment. The step of controlling the first indoor heat exchanger 150 and/or the second indoor heat exchanger 250 to heat includes the followings.

A heating capacity demand in the heating mode is acquired.

In order to acquire the heating capacity demand, it is needed to acquire a target temperature of the user, a current indoor temperature and an outdoor ambient temperature. According to the target temperature, the current indoor temperature and the outdoor ambient temperature, a heating capacity needed to increase the current indoor temperature to the target temperature, or a heating capacity needed to be provided per unit time is calculated, which is namely the heating capacity needed to be provided by the first indoor heat exchanger 150 and the second indoor heat exchanger 250 jointly, or the heating capacity needed to be provided per unit time.

A calculated working frequency needed by a single compressor is calculated according to the heating capacity demand.

According to the heating capacity demand, when all the heating capacity is provided by one indoor heat exchanger, a working frequency (the calculated working frequency) needed by the compressor is calculated, which is namely the working frequency needed by the compressor when the heating capacity is provided by one compressor.

Moreover, the calculated working frequency is compared with a second preset frequency range.

A minimum value of the second preset frequency range is greater than zero, and a maximum value of the second preset frequency range is between 75% and 92% of a full-load working frequency of the compressor. Generally, the calculated working frequency is greater than zero, and the calculated working frequency is mainly compared with the maximum value of the second preset frequency range.

It is determined that the calculated working frequency is in the second preset frequency range, and the first indoor heat exchanger 150 or the second indoor heat exchanger 250 is controlled to heat.

When the calculated working frequency is less than or equal to the maximum value of the second preset frequency range, the calculated working frequency is in the second preset frequency range. The first indoor heat exchanger and 150 or the second indoor heat exchanger 250 is independently controlled to heat.

When the calculated working frequency is greater than the maximum value of the second preset frequency range, it is determined that the calculated working frequency is out of the second preset frequency range, and the first indoor heat exchanger 150 and the second indoor heat exchanger 250 are controlled to heat. That is, a single refrigerant circulation system can no longer meet a supply demand of heat energy. It is needed to start the first refrigerant circulation system 100 and the second refrigerant circulation system 200 at the same time. As for load distributions of the first refrigerant circulation system 100 and the second refrigerant circulation system 200, the working frequency of the first compressor 110 being equivalent to the working frequency of the second compressor 210 is taken as an example.

In the dehumidification and reheating mode:

The step of acquiring the working demands of the first indoor heat exchanger 151 and the second indoor heat exchanger 250 according to the mode control instruction includes the followings.

It is determined that the mode control instruction is the dehumidification and reheating mode instruction.

One of the first indoor heat exchanger 150 and the second indoor heat exchanger 250 is controlled to refrigerate, and the other one is controlled to heat.

Specifically, in the embodiment, when the air conditioner determines that the currently acquired control instruction is the dehumidification and reheating mode for refrigeration, the first indoor heat exchanger 150 is controlled to refrigerate, and the second indoor heat exchanger 250 is controlled to heat. Certainly, in some embodiments, the first indoor heat exchanger 150 may also be controlled to heat, and the second indoor heat exchanger 250 may also be controlled to refrigerate.

Specifically, how to realize accurate control needs further analysis at the moment. The step of operating the first refrigerant circulation system 100 and the second refrigerant circulation system 200 according to the working demands of the first indoor heat exchanger 151 and the second indoor heat exchanger 250 specifically includes the followings.

A refrigerating capacity demand in the dehumidification and reheating mode is acquired. A frequency of the compressor of the refrigerant circulation system corresponding to the indoor heat exchanger for refrigeration is controlled according to the refrigerating capacity demand.

In order to acquire the refrigerating capacity demand, it is needed to acquire a target temperature of the user, a target humidity, a current indoor temperature and an outdoor ambient temperature. According to the target temperature, the current indoor temperature and the outdoor ambient temperature, a refrigerating capacity needed to reduce the current indoor temperature to the target temperature, or a refrigerating capacity needed to be provided per unit time is calculated. Taking a case that the first indoor heat exchanger 150 performs refrigeration as an example, the working frequency of the first compressor 110 is calculated according to the refrigerating capacity demand.

A heating capacity demand in the dehumidification and reheating mode is acquired. A frequency of the compressor of the refrigerant circulation system corresponding to the indoor heat exchanger for heating is controlled according to the heating capacity demand.

In order to acquire the heating capacity demand, it is needed to acquire a target temperature of the user, a current indoor temperature and an outdoor ambient temperature. According to the target temperature, the current indoor temperature and the outdoor ambient temperature, a heating capacity needed to increase the current indoor temperature to the target temperature, or a heating capacity needed to be provided per unit time is calculated. Taking a case that the second indoor heat exchanger 250 performs refrigeration as an example, the working frequency of the second compressor 210 is calculated according to the heating capacity demand.

In the defrosting mode:

After the step of acquiring the mode control instruction, the method further includes the following steps.

In S40, working modes of the first outdoor heat exchanger 140 and the second outdoor heat exchanger 240 are acquired according to the mode control instruction.

In S50, the first refrigerant circulation system 100 and the second refrigerant circulation system 200 are operated according to the working modes of the first outdoor heat exchanger 140 and the second outdoor heat exchanger 240.

After acquiring the mode instruction, working state demands of the first outdoor heat exchanger 140 and the second outdoor heat exchanger 240 are acquired according to mode instruction demands. Then, working states of components in the first refrigerant circulation system 100 and the second refrigerant circulation system 200 are controlled according to the working state demands of the first outdoor heat exchanger 140 and the second outdoor heat exchanger 240, so that working states of the first outdoor heat exchanger 140 and the second outdoor heat exchanger 240 meet the requirements.

The step of acquiring the working modes of the first outdoor heat exchanger 140 and the second outdoor heat exchanger 240 according to the mode control instruction includes the followings.

It is determined that the mode control instruction is the defrosting mode instruction. The first outdoor heat exchanger 140 and/or the second outdoor heat exchanger are controlled to heat.

The defrosting mode is divided into a no-feel defrosting mode, an ordinary defrosting mode and a forced defrosting mode, which are described separately hereinafter.

In the no-feel defrosting mode:

It is determined that a current defrosting mode is the no-feel defrosting mode. The first outdoor heat exchanger 140 is controlled to refrigerate, and the second outdoor heat exchanger 240 is controlled to heat. Alternatively, the first outdoor heat exchanger 140 is controlled to heat, and the second outdoor heat exchanger 240 is controlled to refrigerate.

The no-feel defrosting mode refers to maintaining an indoor temperature or protecting a changing trend of the indoor temperature during defrosting of an outdoor machine, so that the user cannot feel the defrosting. Taking a case that the second outdoor heat exchanger 240 is defrosted as an example, the second outdoor heat exchanger 240 is switched from heat absorption to heat release to remove frost on the fins or the refrigerant pipe. The second indoor heat exchanger 250 is switched from heating to refrigeration, and the second indoor heat exchanger 250 provides cold energy into a room. In order to maintain the indoor temperature, it is needed for the first heat exchanger to provide heat energy into the room, and the first outdoor heat exchanger 140 needs to absorb heat.

In this way, during defrosting of the second outdoor heat exchanger 240, the first indoor heat exchanger 150 is switched from dehumidifying to providing heat energy into the room, and the second indoor heat exchanger 250 is switched from providing heat energy to dehumidifying. In this way, not only the indoor temperature may be maintained, but also the room may be continuously dehumidified. In the case that the user cannot feel a change, the second outdoor heat exchanger is defrosted.

Specifically, as for the control of the working frequencies of the first compressor 110 and the second compressor 210, it is needed to perform further analysis. The step of controlling the first outdoor heat exchanger 140 to refrigerate and controlling the second outdoor heat exchanger 240 to heat includes the followings.

An indoor ambient temperature and an outdoor ambient temperature are acquired.

There are many ways to acquire the indoor ambient temperature and the outdoor ambient temperature, the indoor ambient temperature and the outdoor ambient temperature may be determined by a temperature sensor, and may also be acquired by connecting to the Internet, or may be acquired from other devices through a local area network.

A refrigerating capacity or a heating capacity needed to maintain a current indoor ambient temperature is calculated.

The heating capacity or the refrigerating capacity needed to maintain the current indoor ambient temperature is calculated according to the indoor ambient temperature and the outdoor ambient temperature. When the outdoor ambient temperature is higher than the indoor ambient temperature, the indoor heat exchanger needs to provide the refrigerating capacity (a sum of actions of the first indoor heat exchanger 150 and the second indoor heat exchanger 250). When the outdoor ambient temperature is lower than the indoor ambient temperature, the indoor heat exchanger needs to provide the heating capacity (the sum of the actions of the first indoor heat exchanger 150 and the second indoor heat exchanger 250).

According to the refrigerating capacity or the heating capacity needed, operating frequencies of the first compressor 110 and the second compressor 210 are calculated.

Specifically, according to the refrigerating capacity or the heating capacity needed, the operating frequencies of the first compressor 110 and the second compressor 210 are calculated in many ways. An example is taken to describe hereinafter.

According to the refrigerating capacity or the heating capacity needed, a heating capacity needed to be provided by the first indoor heat exchanger 150 and a refrigerating capacity needed to be provided by the second indoor heat exchanger 250 are calculated. Due to no-feel defrosting, when one indoor heat exchanger performs refrigeration, the other indoor heat exchanger performs heating. A case that the first indoor heat exchanger 150 performs heating and the second indoor heat exchanger 250 performs refrigeration is taken as an example.

The operating frequency of the first compressor 110 is calculated according to the heating capacity needed to be provided by the first indoor heat exchanger 150. The more the heating capacity needed to be provided is, the higher the working frequency of the first compressor 110 is, and the less the heating capacity needed to be provided is, the lower the working frequency of the first compressor 110 is. The operating frequency of the second compressor 210 is calculated according to the refrigerating capacity needed to be provided by the second indoor heat exchanger 250. The more the refrigerating capacity needed to be provided is, the higher the working frequency of the second compressor 210 is, and the less the refrigerating capacity needed to be provided is, the lower the working frequency of the first compressor 210 is.

In the ordinary defrosting mode:

It is determined that a current defrosting mode is the ordinary defrosting mode. The first outdoor heat exchanger 140 is controlled to switch from refrigeration to heating, and the second outdoor heat exchanger 240 is controlled to stop heat exchange; or, the second outdoor heat exchanger 240 is controlled to switch from refrigeration to heating, and the first outdoor heat exchanger 140 is controlled to stop heat exchange.

That is, the outdoor heat exchanger to be defrosted performs heating for defrosting, and the other outdoor heat exchanger does not need to be operated.

In the forced defrosting mode:

It is determined that a current defrosting mode is the forced defrosting mode. The first outdoor heat exchanger 140 is controlled to heat, and the second outdoor heat exchanger 240 is controlled to heat. In addition to that the outdoor heat exchanger to be defrosted performs heating itself, the other outdoor heat exchanger also performs heating to assist the defrosting of the outdoor heat exchanger to be defrosted. For example, when the first outdoor heat exchanger 140 is defrosted, the first outdoor heat exchanger 140 performs heating to defrost itself, and the second outdoor heat exchanger 240 performs heating to convey the heating capacity to the fins and the refrigerant pipe of the first outdoor heat exchanger 140, thus assisting the defrosting of the first outdoor heat exchanger 140.

In a compatible mode (personalized mode), different working modes may be acquired to satisfy different rooms, for example, a first room is heated, a second room is refrigerated, and a third room is dehumidified and reheated.

Certainly, this control way is based on having a plurality of first indoor units and/or a plurality of second indoor units. The first refrigerant circulation system further includes: a first connection pipe branched from a first gas-side piping, and a second connection pipe branched from a first liquid-side piping; and the first refrigerant circulation system further includes a plurality of first indoor units, and the plurality of first indoor units are connected in parallel onto the first connection pipe and the second connection pipe. The second refrigerant circulation system further includes a third connection pipe branched from a second gas-side piping, and a fourth connection pipe branched from a second liquid-side piping; and the second refrigerant circulation system further includes a plurality of second indoor units, and the plurality of second indoor units are connected in parallel onto the third connection pipe and the fourth connection pipe.

After the step of acquiring the working demands of the first indoor heat exchanger and the second indoor heat exchanger according to the mode control instruction, the method further includes the following steps.

A current working mode of the first refrigerant circulation system is acquired.

The current working mode of the first refrigerant circulation system is acquired, which may be refrigeration, heating, or turning off. There are many ways to acquire the current working mode of the first refrigerant circulation system, including a way of directly detecting a flow volume of a refrigerant in a refrigerant pipeline and detecting a temperature of a refrigerant pipe, and a way of acquiring according to working states of other first heat exchangers.

When determining that the working demand of the first indoor heat exchanger is the same as the current working mode of the first refrigerant circulating system, the first indoor throttle device corresponding to the first indoor heat exchanger is turned on.

When determining that the working demand of the first indoor heat exchanger is different from the current working mode of the first refrigerant circulating system, the first indoor throttle device corresponding to the first indoor heat exchanger is turned off.

If the working demand of the current first indoor heat exchanger is heating, when the working mode of the current first refrigerant circulation system is also heating, the first indoor throttle device corresponding to the current first indoor heat exchanger is turned on, and when the working mode of the current first refrigerant circulation system is refrigeration, the first indoor throttle device corresponding to the current first indoor heat exchanger is turned off.

If the working demand of the current first indoor heat exchanger is refrigeration or turning off, when the working mode of the current first refrigerant circulation system is heating, the first indoor throttle device corresponding to the current first indoor heat exchanger is turned off. If the working mode of the current first refrigerant circulation system is refrigeration, it is needed to determine according to the working mode of the second indoor heat exchanger matched with the first indoor heat exchanger. If the second indoor heat exchanger performs refrigeration, the first throttle device (ordinary indoor refrigeration) is turned off, and if the second indoor heat exchanger is turned off, the first throttle device (ordinary indoor refrigeration) is turned on.

If the working mode of the current first refrigerant circulation system is turning off, it is needed to determine according to the working mode of the second indoor heat exchanger matched with the first indoor heat exchanger. If the second indoor heat exchanger performs refrigeration, the first throttle device (ordinary indoor refrigeration) is turned off or turned on, and if the second indoor heat exchanger is turned off, the first throttle device (ordinary indoor refrigeration) is turned on, and the first compressor is started to operate the first refrigerant circulation system.

Similarly, if the working demand of the current first indoor heat exchanger is heating or turning off, when the working mode of the current first refrigerant circulation system is refrigeration, the first indoor throttle device corresponding to the current first indoor heat exchanger is turned off. If the working mode of the current first refrigerant circulation system is heating, it is needed to determine according to the working mode of the second indoor heat exchanger matched with the first indoor heat exchanger. If the second indoor heat exchanger performs heating, the first throttle device (ordinary indoor heating) is turned off, and if the second indoor heat exchanger is turned off, the first throttle device (ordinary indoor heating) is turned on.

If the working mode of the current first refrigerant circulation system is turning off, it is needed to determine according to the working mode of the second indoor heat exchanger matched with the first indoor heat exchanger. If the second indoor heat exchanger performs heating, the first throttle device (ordinary indoor heating) is turned off or turned on, and if the second indoor heat exchanger is turned off, the first throttle device (ordinary indoor heating) is turned on, and the first compressor is started to operate the first refrigerant circulation system.

A current working mode of the second refrigerant circulation system is acquired.

The current working mode of the second refrigerant circulation system is acquired, which may be refrigeration, heating, or turning off. There are many ways to acquire the current working mode of the second refrigerant circulation system, including a way of directly detecting a flow volume of a refrigerant in a refrigerant pipeline and detecting a temperature of a refrigerant pipe, and a way of acquiring according to working states of other second heat exchangers.

When determining that the working demand of the second indoor heat exchanger is the same as the current working mode of the second refrigerant circulating system, the second indoor throttle device corresponding to the second indoor heat exchanger is turned on.

When determining that the working demand of the second indoor heat exchanger is different from the current working mode of the second refrigerant circulating system, the second indoor throttle device corresponding to the second indoor heat exchanger is turned off.

If the working demand of the current second indoor heat exchanger is heating, when the working mode of the current second refrigerant circulation system is also heating, the second indoor throttle device corresponding to the current second indoor heat exchanger is turned on, and when the working mode of the current second refrigerant circulation system is refrigeration, the second indoor throttle device corresponding to the current second indoor heat exchanger is turned off.

If the working demand of the current second indoor heat exchanger is refrigeration or turning off, when the working mode of the current second refrigerant circulation system is heating, the second indoor throttle device corresponding to the current second indoor heat exchanger is turned off. If the working mode of the current second refrigerant circulation system is refrigeration, it is needed to determine according to the working mode of the first indoor heat exchanger matched with the second indoor heat exchanger. If the first indoor heat exchanger performs refrigeration, the second throttle device (ordinary indoor refrigeration) is turned off, and if the first indoor heat exchanger is turned off, the second throttle device (ordinary indoor refrigeration) is turned on.

If the working mode of the current second refrigerant circulation system is turning off, it is needed to determine according to the working mode of the first indoor heat exchanger matched with the second indoor heat exchanger. If the first indoor heat exchanger performs refrigeration, the second throttle device (ordinary indoor refrigeration) is turned off or turned on, and if the first indoor heat exchanger is turned off, the second throttle device (ordinary indoor refrigeration) is turned on, and the second compressor is started to operate the second refrigerant circulation system.

Similarly, if the working demand of the current second indoor heat exchanger is heating or turning off, when the working mode of the current second refrigerant circulation system is refrigeration, the second indoor throttle device corresponding to the current second indoor heat exchanger is turned off. If the working mode of the current second refrigerant circulation system is heating, it is needed to determine according to the working mode of the first indoor heat exchanger matched with the second indoor heat exchanger. If the first indoor heat exchanger performs heating, the second throttle device (ordinary indoor heating) is turned off, and if the first indoor heat exchanger is turned off, the second throttle device (ordinary indoor heating) is turned on.

If the working mode of the current second refrigerant circulation system is turning off, it is needed to determine according to the working mode of the first indoor heat exchanger matched with the second indoor heat exchanger. If the first indoor heat exchanger performs heating, the second throttle device (ordinary indoor heating) is turned off or turned on, and if the first indoor heat exchanger is turned off, the second throttle device (ordinary indoor heating) is turned on, and the second compressor is started to operate the second refrigerant circulation system.

In some embodiments, in order to simplify an algorithm logic, before the step of acquiring the current working mode of the first refrigerant circulation system, the method further includes the following steps.

Working states of all first indoor heat exchangers are acquired.

The first refrigerant circulation system includes a plurality of first indoor units, and each first indoor unit includes a first heat exchanger. The working states of the first indoor units may be refrigeration, heating or turning off.

It is determined that at least one first indoor heat exchanger is already operated, and a current working mode of the first refrigerant circulation system is acquired.

When the first indoor heat exchanger performs heating, the first refrigerant circulation system performs heating. When the first indoor heat exchanger performs heating, the first refrigerant circulation system performs heating. On this basis, the first throttle device corresponding to the current first indoor heat exchanger is controlled (turned on or turned off).

It is determined that no first indoor heat exchanger is already operated, and the working mode of the first refrigerant circulation system is determined according to a working demand of the current first indoor heat exchanger.

When all the first indoor heat exchangers are not operated, according to the demand of the current first indoor heat exchanger, the first compressor is started and the first refrigerant circulation system is operated, so that the working mode of the first refrigerant circulation system is the same as the demand of the current first indoor heat exchanger.

In some embodiments, in order to simplify an algorithm logic, before the step of acquiring the current working mode of the second refrigerant circulation system, the method further includes the following steps.

Working states of all second indoor heat exchangers are acquired.

The second refrigerant circulation system includes a plurality of second indoor units, and each second indoor unit includes a second heat exchanger. The working states of the second indoor units may be refrigeration, heating or turning off.

It is determined that at least one second indoor heat exchanger is already operated, and a current working mode of the second refrigerant circulation system is acquired.

When the second indoor heat exchanger performs heating, the second refrigerant circulation system performs heating. When the second indoor heat exchanger performs heating, the second refrigerant circulation system performs heating. On this basis, the second throttle device corresponding to the current second indoor heat exchanger is controlled (turned on or turned off).

It is determined that no second indoor heat exchanger is already operated, and the working mode of the second refrigerant circulation system is determined according to a working demand of the current second indoor heat exchanger.

When all the second indoor heat exchangers are not operated, according to the demand of the current second indoor heat exchanger, the second compressor is started and the second refrigerant circulation system is operated, so that the working mode of the second refrigerant circulation system is the same as the demand of the current second indoor heat exchanger.

The above description is only several embodiments of the present disclosure, and is not intended to limit the patent scope of the present disclosure. The equivalent structural transformation made under the inventive concept of the present disclosure by using the contents of the specification and the drawings of the present disclosure, or the direct/indirect application in other related technical fields is included in the scope of the present disclosure.

The invention claimed is:

1. An air conditioner comprising:

a first refrigerant circulation system including:

a first indoor unit including a first indoor heat exchanger and a first indoor throttle device;

a first outdoor unit including a first compressor and a first outdoor heat exchanger;

a first exhaust pipe arranged at an exhaust port of the first compressor;

a first intake pipe arranged at an intake port of the first compressor;

a first liquid-side piping connecting the first exhaust pipe, the first outdoor heat exchanger, the first indoor throttle device, and the first indoor heat exchanger in sequence; and a first gas-side piping connecting the first indoor heat exchanger and the first intake pipe;

a second refrigerant circulation system including:

a second indoor unit including a second indoor heat exchanger and a second indoor throttle device;

a second outdoor unit including a second compressor and a second outdoor heat exchanger;

a second exhaust pipe arranged at an exhaust port of the second compressor;

a second intake pipe arranged at an intake port of the second compressor;

a second liquid-side piping connecting the second intake pipe, the second outdoor heat exchanger, the second indoor throttle device, and the second indoor heat exchanger in sequence; and a second gas-side piping connecting the second indoor heat exchanger and the second exhaust pipe; and a heat circulation device configured to convey heat energy or cold energy of at least one of the first indoor heat exchanger or the second indoor heat exchanger into a room;

wherein:

the first refrigerant circulation system further includes:

a first gas-liquid separator arranged at the first intake pipe; and a first economizer arranged at the first liquid-side piping between the first outdoor heat exchanger and the first indoor throttle device, a first return pipe of the first economizer being communicated with the first gas-liquid separator;

and/or the second refrigerant circulation system further includes:

a second gas-liquid separator arranged at the second intake pipe; and a second economizer arranged at the second liquid-side piping between the second outdoor heat exchanger and the second indoor throttle device, a second return pipe of the second economizer being communicated with the second gas-liquid separator.

2. The air conditioner according to claim 1, further comprising:

an indoor casing including an air inlet, an air outlet, and an air duct connecting the air inlet and the air outlet;

wherein:

the first indoor heat exchanger and the second indoor heat exchanger are arranged in the air duct; and the heat circulation device includes a fan arranged in the air duct.

3. The air conditioner according to claim 1, wherein:

the first outdoor heat exchanger and the second outdoor heat exchanger are integrally arranged;

refrigerant pipes of the first outdoor heat exchanger and the second outdoor heat exchanger are arranged in a same heat exchanger set;

the first outdoor heat exchanger includes a plurality of first refrigerant pipe sections;

the second outdoor heat exchanger includes a plurality of second refrigerant pipe sections; and the first refrigerant pipe sections and the second refrigerant pipe sections are alternately arranged.

4. The air conditioner according to claim 1, wherein:

the first refrigerant circulation system further includes a first reversing device arranged among the first exhaust pipe, the first liquid-side piping, the first gas-side piping, and the first intake pipe, so that one of the first exhaust pipe and the first intake pipe is communicated with the first liquid-side piping and another one of the first exhaust pipe and the first intake pipe is communicated with the first gas-side piping; and/or the second refrigerant circulation system further includes a second reversing device arranged among the second exhaust pipe, the second liquid-side piping, the second gas-side piping and the second intake pipe, so that one of the second exhaust pipe and the second intake pipe is communicated with the second liquid-side piping and another one of the second exhaust pipe and the second intake pipe is communicated with the second gas-side piping.

5. The air conditioner according to claim 1, wherein:

the first refrigerant circulation system further includes a first outdoor throttle device arranged at the first liquid-side piping; and/or the second refrigerant circulation system further includes a second outdoor throttle device arranged at the second liquid-side piping.

6. The air conditioner according to claim 1, wherein:

the first refrigerant circulation system further includes:

a first connection pipe branched from the first gas-side piping; and a second connection pipe branched from the first liquid-side piping;

wherein the first indoor unit is one of a plurality of first indoor units of the first refrigerant circulation system that are connected in parallel to the first connection pipe and the second connection pipe; and/or the second refrigerant circulation system further includes:

a third connection pipe branched from the second gas-side piping; and a fourth connection pipe branched from the second liquid-side piping;

wherein the second indoor unit is one of a plurality of second indoor units of the second refrigerant circulation system that are connected in parallel to the third connection pipe and the fourth connection pipe.

7. The air conditioner according to claim 1, further comprising:

a water treatment device including a water heat exchanger and a water container, the water heat exchanger is configured to heat or refrigerate water in the water container;

wherein:

the first refrigerant circulation system further includes a first connection pipe branched from the first gas-side piping and a second connection pipe branched from the first liquid-side piping, the water heat exchanger and the first indoor unit being connected in parallel to the first connection pipe and the second connection pipe; and/or the second refrigerant circulation system further includes a third connection pipe branched from the second gas-side piping and a fourth connection pipe branched from the second liquid-side piping, the water heat exchanger and the second indoor unit being connected in parallel to the third connection pipe and the fourth connection pipe.

8. The air conditioner according to claim 1, further comprising:

a heat exchange water tank; and a floor-heating water flow pipe communicated with the heat exchange water tank, a floor-heating heat exchanger being arranged in the heat exchange water tank;

wherein:

the first refrigerant circulation system further includes a first connection pipe branched from the first gas-side piping and a second connection pipe branched from the first liquid-side piping, the floor-heating heat exchanger and the first indoor unit being connected in parallel to the first connection pipe and the second connection pipe; and/or the second refrigerant circulation system further includes a third connection pipe branched from the second gas-side piping and a fourth connection pipe branched from the second liquid-side piping, the floor-heating heat exchanger and the second indoor unit being connected in parallel onto the third connection pipe and the fourth connection pipe.

9. A control method for an air conditioner comprising:

acquiring a mode control instruction for the air conditioner, the air conditioner including:

a first refrigerant circulation system including a first indoor unit, the first indoor unit including a first indoor heat exchanger; and a second refrigerant circulation system including a second indoor unit, the second indoor unit including a second indoor heat exchanger;

acquiring working demands of the first indoor heat exchanger and the second indoor heat exchanger according to the mode control instruction, including:

determining that the mode control instruction is an instruction for a dehumidification and reheating mode; and determining to control the first indoor heat exchanger to refrigerate, and to control the second indoor heat exchanger to heat; and controlling the first refrigerant circulation system and the second refrigerant circulation system to operate according to the working demands, including:

acquiring a refrigerating capacity demand in the dehumidification and reheating mode;

controlling a frequency of a compressor of the first refrigerant circulation system according to the refrigerating capacity demand;

acquiring a heating capacity demand in the dehumidification and reheating mode; and controlling a frequency of a compressor of the second refrigerant circulation system according to the heating capacity demand.

10. The control method according to claim 9, wherein acquiring the working demands further includes:

determining that the mode control instruction is an instruction for a refrigerating mode; and determining to control at least one of the first indoor heat exchanger or the second indoor heat exchanger to refrigerate.

11. The control method according to claim 10, wherein determining to control the at least one of the first indoor heat exchanger or the second indoor heat exchanger to refrigerate includes:

acquiring a refrigerating capacity demand in the refrigerating mode;

calculating a working frequency needed by a single compressor according to the refrigerating capacity demand;

comparing the working frequency with a preset frequency range to obtain a comparison result; and determining to control the at least one of the first indoor heat exchanger or the second indoor heat exchanger to refrigerate according to the comparison result, including:

in response to the comparison result indicating that the working frequency is in the preset frequency range, determining to control the first indoor heat exchanger or the second indoor heat exchanger to refrigerate; or in response to the comparison result indicating that the working frequency is out of the preset frequency range, determining to control the first indoor heat exchanger and the second indoor heat exchanger to refrigerate.

12. The control method according to claim 9, wherein acquiring the working demands further includes:

determining that the mode control instruction is an instruction for a heating mode; and determining to control at least one of the first indoor heat exchanger or the second indoor heat exchanger to heat.

13. The control method according to claim 12, wherein determining to control the first indoor heat exchanger or the second indoor heat exchanger to heat comprises:

acquiring a heating capacity demand in the heating mode;

calculating a working frequency needed by a single compressor according to the heating capacity demand;

comparing the working frequency with a preset frequency range to obtain a comparison result; and determining to control the at least one of the first indoor heat exchanger or the second indoor heat exchanger to heat according to the comparison result, including:

in response to the comparison result indicating that the working frequency is in the preset frequency range, determining to control the first indoor heat exchanger or the second indoor heat exchanger to heat; or in response to the comparison result indicating that the working frequency is out of the preset frequency range, determining to control the first indoor heat exchanger and the second indoor heat exchanger to heat.

14. The control method according to claim 9, further comprising, after acquiring the mode control instruction:

acquiring working modes of a first outdoor heat exchanger of the first refrigerant circulation system and a second outdoor heat exchanger of the second refrigerant circulation system according to the mode control instruction; and controlling the first refrigerant circulation system and the second refrigerant circulation system to operate according to the working modes.

15. The control method according to claim 14, wherein acquiring the working modes includes:

determining that the mode control instruction is a defrosting mode instruction; and determining to control at least one of the first outdoor heat exchanger or the second outdoor heat exchanger to heat.

16. The control method according to claim 15, wherein determining to control the at least one of the first outdoor heat exchanger or the second outdoor heat exchanger to heat includes:

determining that a current defrosting mode is a no-feel defrosting mode, and determining to control the first outdoor heat exchanger to refrigerate and to control the second outdoor heat exchanger to heat;

determining that the current defrosting mode is an ordinary defrosting mode, and determining to control the first outdoor heat exchanger to switch from refrigeration to heating and to control the second outdoor heat exchanger to stop heat exchange; or determining that the current defrosting mode is a forced defrosting mode, and determining to control the first outdoor heat exchanger and the second outdoor heat exchanger to heat.

17. A control method for an air conditioner comprising:

acquiring a mode control instruction for the air conditioner, the air conditioner including:

a first refrigerant circulation system including a first indoor unit, the first indoor unit including a first indoor heat exchanger; and a second refrigerant circulation system including a second indoor unit, the second indoor unit including a second indoor heat exchanger;

acquiring working demands of the first indoor heat exchanger and the second indoor heat exchanger according to the mode control instruction, including:

determining that the mode control instruction is an instruction for a refrigerating mode; and determining to control at least one of the first indoor heat exchanger or the second indoor heat exchanger to refrigerate, including:

acquiring a refrigerating capacity demand in the refrigerating mode;

calculating a working frequency needed by a single compressor according to the refrigerating capacity demand;

comparing the working frequency with a preset frequency range to obtain a comparison result; and determining to control the at least one of the first indoor heat exchanger or the second indoor heat exchanger to refrigerate according to the comparison result, including:

in response to the comparison result indicating that the working frequency is in the preset frequency range, determining to control the first indoor heat exchanger or the second indoor heat exchanger to refrigerate; or in response to the comparison result indicating that the working frequency is out of the preset frequency range, determining to control the first indoor heat exchanger and the second indoor heat exchanger to refrigerate; and controlling the first refrigerant circulation system and the second refrigerant circulation system to operate according to the working demands.

* * * * *